US007557784B2

(12) United States Patent
Kwak et al.

(10) Patent No.: US 7,557,784 B2
(45) Date of Patent: Jul. 7, 2009

(54) OLED PIXEL CIRCUIT AND LIGHT EMITTING DISPLAY USING THE SAME

(75) Inventors: Won Kyu Kwak, Seongnam (KR); Sung Cheon Park, Suwon (KR)

(73) Assignee: Samsung Mobile Display Co., Ltd., Suwon-si (KR)

( * ) Notice: Subject to any disclaimer, the term of this patent is extended or adjusted under 35 U.S.C. 154(b) by 587 days.

(21) Appl. No.: 11/274,042

(22) Filed: Nov. 14, 2005

(65) Prior Publication Data

US 2006/0125737 A1 Jun. 15, 2006

(30) Foreign Application Priority Data

Nov. 22, 2004 (KR) ..... 10-2004-0095983

(51) Int. Cl.
*G09G 3/32* (2006.01)

(52) U.S. Cl. ..... 345/82; 345/205

(58) Field of Classification Search ..... 345/82, 345/205, 206
See application file for complete search history.

(56) References Cited

U.S. PATENT DOCUMENTS

| | | | | |
|---|---|---|---|---|
| 5,822,026 | A | 10/1998 | Matsuo | |
| 6,583,775 | B1 | 6/2003 | Sekiya et al. | |
| 6,618,031 | B1 | 9/2003 | Bohn, Jr. et al. | |
| 6,768,482 | B2 | 7/2004 | Asano et al. | |
| 6,933,756 | B2 * | 8/2005 | Miyazawa | 327/112 |
| 7,015,884 | B2 | 3/2006 | Kwon | |
| 7,336,251 | B2 * | 2/2008 | Osada | 345/92 |
| 2002/0021293 | A1 | 2/2002 | Tam | |
| 2003/0094612 | A1 * | 5/2003 | Yamazaki et al. | 257/59 |
| 2003/0117348 | A1 | 6/2003 | Knapp et al. | |
| 2003/0132896 | A1 | 7/2003 | Matsueda | |
| 2004/0113922 | A1 | 6/2004 | Choe et al. | |
| 2004/0263499 | A1 | 12/2004 | Tanada et al. | |

(Continued)

FOREIGN PATENT DOCUMENTS

CN 1143232 A 2/1997

(Continued)

OTHER PUBLICATIONS

Patent Abstracts of Japan, Publication No. 2003-043999, Published on Feb. 14, 2003, in the name of Suzuki.

(Continued)

*Primary Examiner*—Regina Liang
*Assistant Examiner*—Shaheda A Abdin
(74) *Attorney, Agent, or Firm*—Christie Parker & Hale LLP

(57) ABSTRACT

A pixel and a light emitting display including the pixel. The pixel includes first and second organic light emitting diodes (OLEDs), a driving circuit commonly connected to the plurality of OLEDs to drive the first and second OLEDs, a switching circuit connected between the first and second OLEDs and the driving circuit to sequentially control the driving of the first and second OLEDs using first and second emission control signals, and a reverse bias circuit for selectively applying a reverse bias voltage including at least one of the first and second emission control signals to the first and second OLEDs. Therefore, the reverse bias can be easily applied in the periods when the OLEDs do not emit light and thus can improve the characteristics of the OLEDs.

24 Claims, 11 Drawing Sheets

U.S. PATENT DOCUMENTS

| | | | | |
|---|---|---|---|---|
| 2005/0024305 | A1* | 2/2005 | Park | 345/82 |
| 2005/0052365 | A1 | 3/2005 | Jang | |
| 2005/0068271 | A1 | 3/2005 | Lo | |
| 2006/0076550 | A1 | 4/2006 | Kwak et al. | |
| 2006/0132668 | A1 | 6/2006 | Park et al. | |

FOREIGN PATENT DOCUMENTS

| | | | |
|---|---|---|---|
| CN | 1361510 | | 7/2002 |
| CN | 1376014 | A | 10/2002 |
| CN | 1410962 | A | 4/2003 |
| CN | 1530910 | A | 9/2004 |
| JP | 9-138659 | | 5/1997 |
| JP | 2001-318628 | | 11/2001 |
| JP | 2002-023697 | | 1/2002 |
| JP | 2002-175029 | | 6/2002 |
| JP | 2002-215093 | | 7/2002 |
| JP | 2002-215096 | | 7/2002 |
| JP | 2002198174 | | 7/2002 |
| JP | 2002-221917 | | 8/2002 |
| JP | 2003-43999 | | 2/2003 |
| JP | 2003-108032 | | 4/2003 |
| JP | 2003-122306 | | 4/2003 |
| JP | 2003-216100 | | 7/2003 |
| JP | 2004-133240 | | 4/2004 |
| KR | 2000-0039659 | | 7/2000 |
| KR | 2001-0050783 | | 6/2001 |
| KR | 2002-0025842 | | 4/2002 |
| KR | 2002-0040613 | | 5/2002 |
| KR | 2003-0027858 | | 4/2003 |
| KR | 2003-0086166 | | 11/2003 |
| KR | 10-2004-0029242 | | 4/2004 |
| WO | WO 03/044762 | A1 | 5/2003 |
| WO | WO 03/071511 | | 8/2003 |

OTHER PUBLICATIONS

U.S. Office action dated Oct. 3, 2008, for related U.S. Appl. No. 11/239,726, indicating relevance of U.S. Patent 6,618,031, and U.S. Publication 2003/0117348, filed in an IDS dated Oct. 31, 2008.

U.S. Office action dated Nov. 13, 2008, for related U.S. Appl. No. 11/129,016, indicating relevance of listed U.S. references in the IDS.

Patent Abstracts of Japan, Publication No. 09-138659, dated May 27, 1997, in the name of Chan-Long Shieh et al.

Patent Abstracts of Japan, Publication No. 2001-318628, dated Nov. 16, 2001, in the name of Shunpei Yamazaki et al.

Patent Abstracts of Japan, Publication No. 2002-023697, dated Jan. 23, 2002, in the name of Kazutaka Inukai.

Patent Abstracts of Japan, Publication No. 2002-175029, dated Jun. 21, 2002, in the name of Anzai Katsuya et al.

Patent Abstracts of Japan, Publication No. 2002-198174, dated Jul. 12, 2002, in the name of Yuichi Ikezu et al.

Patent Abstracts of Japan, Publication No. 2002-215093 dated Jul. 31, 2002, in the name of Akira Yumoto et al.

Patent Abstracts of Japan, Publication No. 2002-215096, dated Jul. 31, 2002, in the name of Oh-Kyong Kwon.

Patnet Abstracts of Japan, Publication No. 2002-221917, dated Aug. 9, 2002, in the name of Shin Asano et al.

Patent Abstracts of Japan, Publication No. 2003-108032, dated Apr. 11, 2003, in the name of Katsuya Anzai.

Patent Abstracts of Japan, Publication No. 2003-122306, dated Apr. 25, 2003, in the name of Akira Yumoto.

Patent Abstracts of Japan, Publication No. 2003-216100, dated Jul. 30, 2003, in the name of Hiroshi Takahara.

Patent Abstracts of Japan, Publication No. 2004-133240, dated Apr. 30, 2004, in the name of Shin Asano et al.

Korean Patent Abstracts, Publication No. 1020000039659 A; Date of Publication: Jul. 5, 2000; in the name of U Yeong Kim et al.

Korean Patent Abstracts, Publication No. 1020010050783 A; Date of Publication: Jun. 25, 2001; in the name of Tsutomu Yamada.

Korean Patent Abstracts, Publication No. 1020020025842 A, dated Apr. 4, 2002, in the name of Katsuya Anzai et al.

Korean Patent Abstracts, Publication No. 1020020040613 A, dated May 30, 2002, in the name of Mitsuru Asano.

Korean Patent Abstracts, Publication No. 1020030027858 A, dated Apr. 7, 2003, in the name of Katsuya Anzai.

Korean Patent Abstracts, Publication No. 1020030086166 A; Date of Publication: Nov. 7, 2003; in the name of Gi Seong Chae et al.

Korean Patent Abstracts, Publication No. 1020040029242 A; Date of Publication: Apr. 6, 2004l in te name of Jong Cheol Chae et al.

* cited by examiner

OLED PIXEL CIRCUIT AND LIGHT EMITTING DISPLAY USING THE SAME

CROSS-REFERENCE TO RELATED APPLICATION

This application claims priority to and the benefit of Korean Patent Application No. 10-2004-0095983, filed on Nov. 22, 2004, in the Korean Intellectual Property Office, the entire contents of which is incorporated herein by reference.

BACKGROUND

1. Field of the Invention

The present invention relates to a pixel and a light emitting display, and more particularly, to a pixel and a light emitting display using the pixel, the pixel including a plurality of organic light emitting diodes (OLEDs) so that an aperture ratio of the light emitting display can be improved and a reverse bias voltage can be easily applied to the OLEDs.

2. Discussion of Related Art

Recently, various flat panel displays having weight and volume less than comparable cathode ray tube (CRT) displays have been developed. In particular, light emitting displays having high luminous efficiency, high brightness, wide view angle, and high response speed are in the limelight.

An organic light emitting diode (OLED) has a structure in which an emission layer that is a thin film for emitting light is positioned between a cathode electrode and an anode electrode. Electrons and holes are injected into the emission layer so that they can be recombined to generate exciters that emit light when their energies are reduced.

A light emitting diode (LED) includes an emission layer that can be formed of an organic or inorganic material. As such, the LED can be classified as either an inorganic LED or an organic LED (or OLED), depending on the type of the emission layer.

FIGS. 1A and 1B illustrate a conventional OLED. Referring to FIGS. 1A and 1B, the OLED includes an emission layer EL, a hole transfer layer HTL, and an electron transfer layer ETL formed between an anode electrode 20 and a cathode electrode 21.

The anode electrode 20 is connected to a first power source so as to supply holes to the emission layer EL. The cathode electrode 20 is connected to a second power source lower than the first power source so as to supply electrons to the emission layer EL. That is, the anode electrode 20 has positive (+) potential higher than the potential of the cathode electrode 21, and the cathode electrode 21 has negative (−) potential lower than the potential of the anode electrode 20.

The hole transfer layer HTL accelerates the holes supplied from the anode electrode 20 to supply the holes to the emission layer EL. The electron transfer layer ETL accelerates the electrons supplied from the cathode electrode 21 to supply the electrons to the emission layer EL. The holes supplied from the hole transfer layer HTL and the electrons supplied from the electron transfer layer ETL collide with the emission layer EL. At this time, the electrons and the holes are recombined with each other. Therefore, predetermined light is generated. In more detail, the emission layer EL is formed of an organic material so that, when the electrons and the holes are recombined with each other, one of red R, green G, and blue B light components is generated.

In addition, the OLED includes a hole injection layer HIL positioned between the hole transfer layer HTL and the anode electrode 20 and an electron injection layer EIL positioned between the electron transfer layer ETL and the cathode electrode 21. The hole injection layer HIL supplies the holes to the hole transfer layer HTL. The electron injection layer EIL supplies the electrons to the electron transfer layer ETL.

FIG. 2 is a circuit diagram of a part of a conventional light emitting display. Referring to FIG. 2, four pixels are adjacent to each other, and each pixel includes an OLED and a pixel circuit. The pixel circuit includes a first transistor T1, a second transistor T2, a third transistor T3, and a capacitor Cst. Each of the first, second, and third transistors T1, T2, and T3 includes a gate, a source, and a drain; and the capacitor Cst includes a first electrode and a second electrode.

Since the pixels have the same structure, only the pixel on the left top will be described in more detail. The source of the first transistor T1 is connected to a power source Vdd through a power source supply line, the drain of the first transistor T1 is connected to the source of the third transistor T3, and the gate of the first transistor T1 is connected to a node A. The node A is connected to the drain of the second transistor T2. The first transistor T1 supplies a current corresponding to a data signal to the OLED.

The source of the second transistor T2 is connected to a data line D1, the drain of the second transistor T2 is connected to the node A, and the gate of the second transistor T2 is connected to a scan line S1. The second transistor T2 applies the data signal to the node A in accordance with a scan signal applied to the gate thereof.

The source of the third transistor T3 is connected to the drain of the first transistor T1, the drain of the third transistor T3 is connected to an anode electrode of the OLED, and the gate of the third transistor T3 is connected to an emission control line E1 to respond to an emission control signal. Therefore, the third transistor T3 controls the flow of a current that flows from the first transistor T1 to the OLED in accordance with the emission control signal to control emission of the OLED.

The first electrode of the capacitor Cst is connected to the power source Vdd through the power source supply line, and the second electrode of the capacitor Cst is connected to the node A. The capacitor Cst stores charges in accordance with the data signal and applies a signal to the gate of the first transistor T1 in accordance with the stored charges for one frame so that the operation of the first transistor T1 is maintained for the one frame.

Referring back to FIG. 1B, since the voltage applied from the OLED to the anode electrode 20 is always set higher than the voltage applied to the cathode electrode 21, as illustrated in FIG. 1B, negative (−) carriers are positioned on the anode electrode 20, and positive (+) carriers are positioned on the cathode electrode 21.

Here, when the negative (−) carriers positioned on the anode electrode 20 and the positive (+) carriers positioned on the cathode electrode 21 are maintained for a long period of time, the movements of the electrons and holes that contribute to light emission are reduced so that brightness deteriorates and afterimage is generated.

In particular, the afterimage increases when the same image (for example, a still image) is displayed for a long period of time and deteriorates a display quality. When the afterimage is generated, the OLED deteriorates, and the life of the light emitting display is reduced.

Since one OLED is connected to one pixel circuit, a plurality of pixel circuits are necessary in order to emit light from a plurality of OLEDs so that a large number of the pixel circuits are needed.

Also, as illustrated in FIG. 2, since one emission control line needs to be connected to a pixel row, the aperture ratio of the light emitting display deteriorates due to the emission control line.

SUMMARY OF THE INVENTION

Accordingly, an embodiment of the present invention provides a pixel circuit and a light emitting display using the same, in which a reverse bias (or a reverse bias voltage) can be easily applied to an organic light emitting diode (OLED) to improve the characteristics of the OLED, and/or in which a plurality of OLEDs are connected to one pixel circuit to reduce the number of pixel circuits of a light emitting display and to improve the aperture ratio of the light emitting display.

One embodiment of the present invention provides a pixel including first and second organic light emitting diodes (OLEDs), a driving circuit commonly connected to the first and second OLEDs to drive the first and second OLEDs, a switching circuit connected between the first and second OLEDs and the driving circuit to sequentially control the driving of the first and second OLEDs using first and second emission control signals, and a reverse bias circuit for applying a reverse bias voltage including at least one of the first and second emission control signals to the first and second OLEDs. The driving circuit includes a first transistor for receiving a first power of a first power source to selectively supply a driving current corresponding to a first voltage applied to a gate of the first transistor to the first and second OLEDs, a second transistor for selectively applying a data signal to a first electrode of the first transistor in accordance with a first scan signal, a third transistor for selectively connecting the first transistor to serve as a diode in accordance with the first scan signal so that an electric current can flow through to the first transistor, a capacitor for storing the voltage applied to the gate of the first transistor while the data signal is applied to the first electrode of the first transistor and for maintaining the stored voltage at the gate of the first transistor for a period when at least one of the first and second OLEDs emits light, a fourth transistor for selectively applying an initializing voltage to the capacitor in accordance with a second scan signal, a fifth transistor for selectively applying the first power of the first power source to the first transistor in accordance with the first emission control signal, and a sixth transistor for selectively applying the first power of the first power source to the first transistor in accordance with the second emission control signal.

One embodiment of the present invention provides a pixel including first and second organic light emitting diodes (OLEDs), a driving circuit commonly connected to the first and second OLEDs to drive the first and second OLEDs, a switching circuit connected between the first and second OLEDs and the driving circuit to sequentially control the driving of the first and second OLEDs using first and second emission control signals, and a reverse bias circuit connected to a reverse bias line for transmitting a reverse bias voltage to selectively apply the reverse bias voltage to the first and second OLEDs in accordance with the first and second emission control signals so that the reverse bias voltage is applied to the first and second OLEDs. The driving circuit includes a first transistor for receiving a first power source to selectively supply a driving current corresponding to a first voltage applied to a gate of the first transistor to the first and second OLEDs, a second transistor for selectively applying the data signal to a first electrode of the first transistor in accordance with a first scan signal, a third transistor for selectively connecting the first transistor to serve as a diode in accordance with the first scan signal so that an electric current can flow through the first transistor, a capacitor for storing the voltage applied to the gate of the first transistor while the data signal is applied to the first electrode of the first transistor and for maintaining the stored voltage at the gate of the first transistor for a period when at least one of the first and second OLEDs emits light, a fourth transistor for selectively applying an initializing voltage to the capacitor in accordance with a second scan signal, a fifth transistor for selectively applying the first power of the first power source to the first transistor in accordance with the first emission control signal, and a sixth transistor for selectively applying the first power of the first power source to the first transistor in accordance with the second emission control signal.

One embodiment of the present invention provides a pixel including first and second organic light emitting diodes (OLEDs), a driving circuit commonly connected to the first and second OLEDs to drive the first and second OLEDs, a switching circuit connected between the first and second OLEDs and the driving circuit to sequentially control the driving of the first and second OLEDs using first and second emission control signals, and a reverse bias circuit connected to a reverse bias line for transmitting a reverse bias voltage and a reverse bias control line for transmitting a reverse voltage control signal to selectively apply the reverse bias voltage to the first and second OLEDs in accordance with the reverse voltage control signal so that the reverse bias voltage is applied to the first and second OLEDs. The driving circuit includes a first transistor for receiving a first power of a first power source to selectively supply a driving current corresponding to a first voltage applied to a gate of the first transistor to the first and second OLEDs, a second transistor for selectively applying the data signal to a first electrode of the first transistor in accordance with a first scan signal, a third transistor for selectively connecting the first transistor to serve as a diode in accordance with the first scan signal so that an electric current can flow through the first transistor, a capacitor for storing the voltage applied to the gate of the first transistor while the data signal is applied to the first electrode of the first transistor and for maintaining the stored voltage at the gate of the first transistor for a period when at least one of the first and second OLEDs emits light, a fourth transistor for selectively applying an initializing voltage to the capacitor in accordance with a second scan signal, a fifth transistor for selectively applying the first power source to the first transistor in accordance with the first emission control signal, and a sixth transistor for selectively applying the first power of the first power source to the first transistor in accordance with the second emission control signal.

One embodiment of the present invention provides a light emitting display including an image display unit including a plurality of pixels to display an image, a scan driver for transmitting first and second scan signals and first and second emission control signals to the image display unit, and a data driver for transmitting a data signal to the image display unit. The pixel is one of the above-described pixels.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive.

In the present application, when a first part is referred to as being connected to a second part, the first may be directly connected to the second part or indirectly connected to the second part via a third part.

Figure 1A:
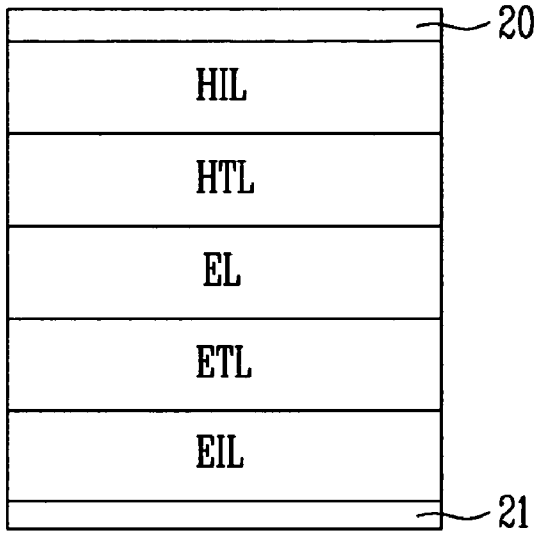
FIG. 1A (PRIOR ART)
FIGS. 1A and 1B illustrate a conventional organic light emitting diode (OLED)
Figure 1B:
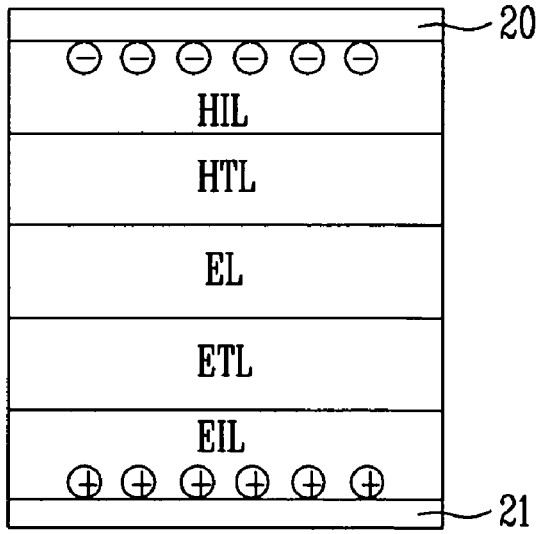
FIG. 1B (PRIOR ART)
Figure 2:
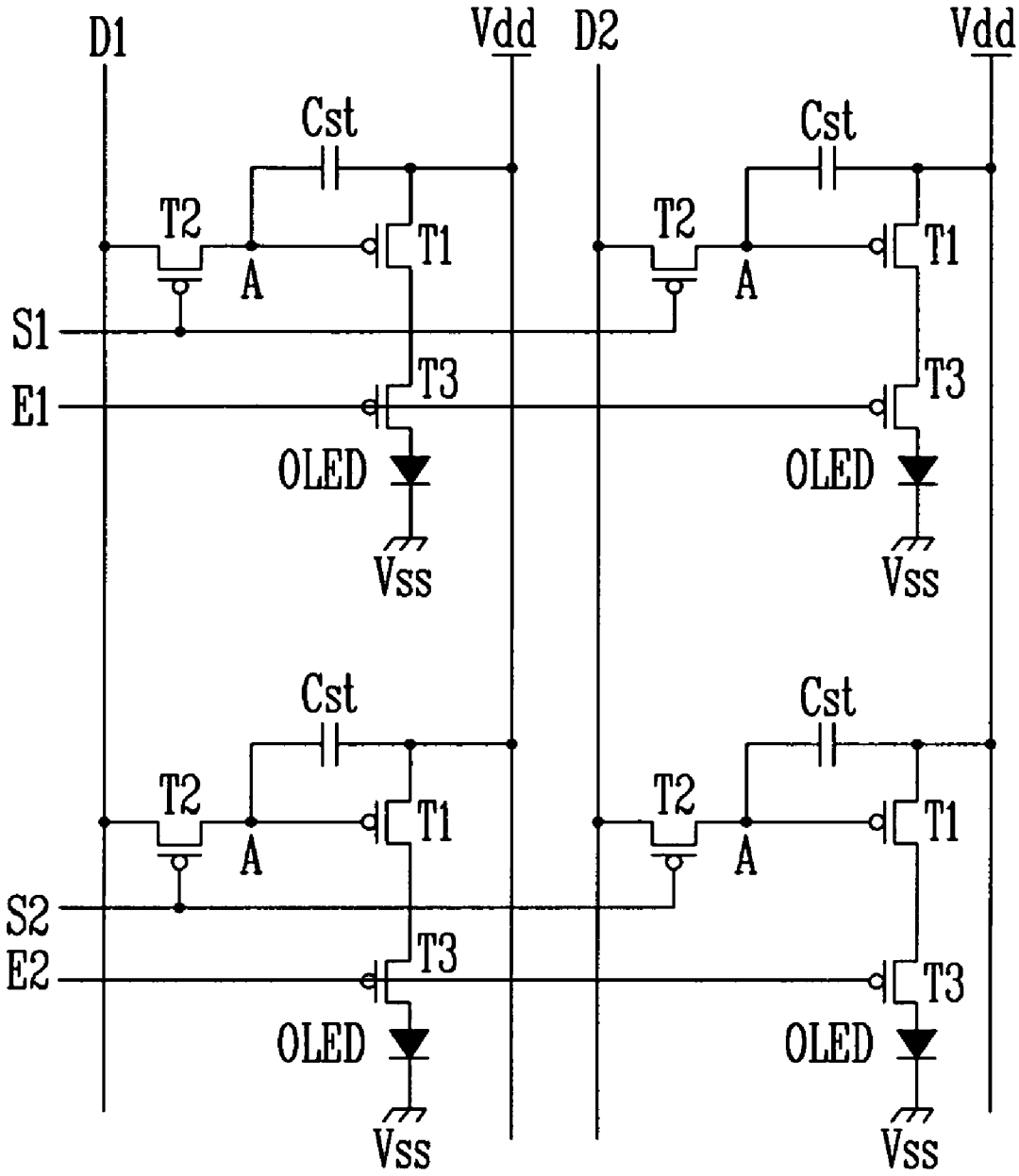
FIG. 2 (PRIOR ART)
FIG. 2 is a circuit diagram illustrating a part of a conventional light emitting display.
Figure 3:
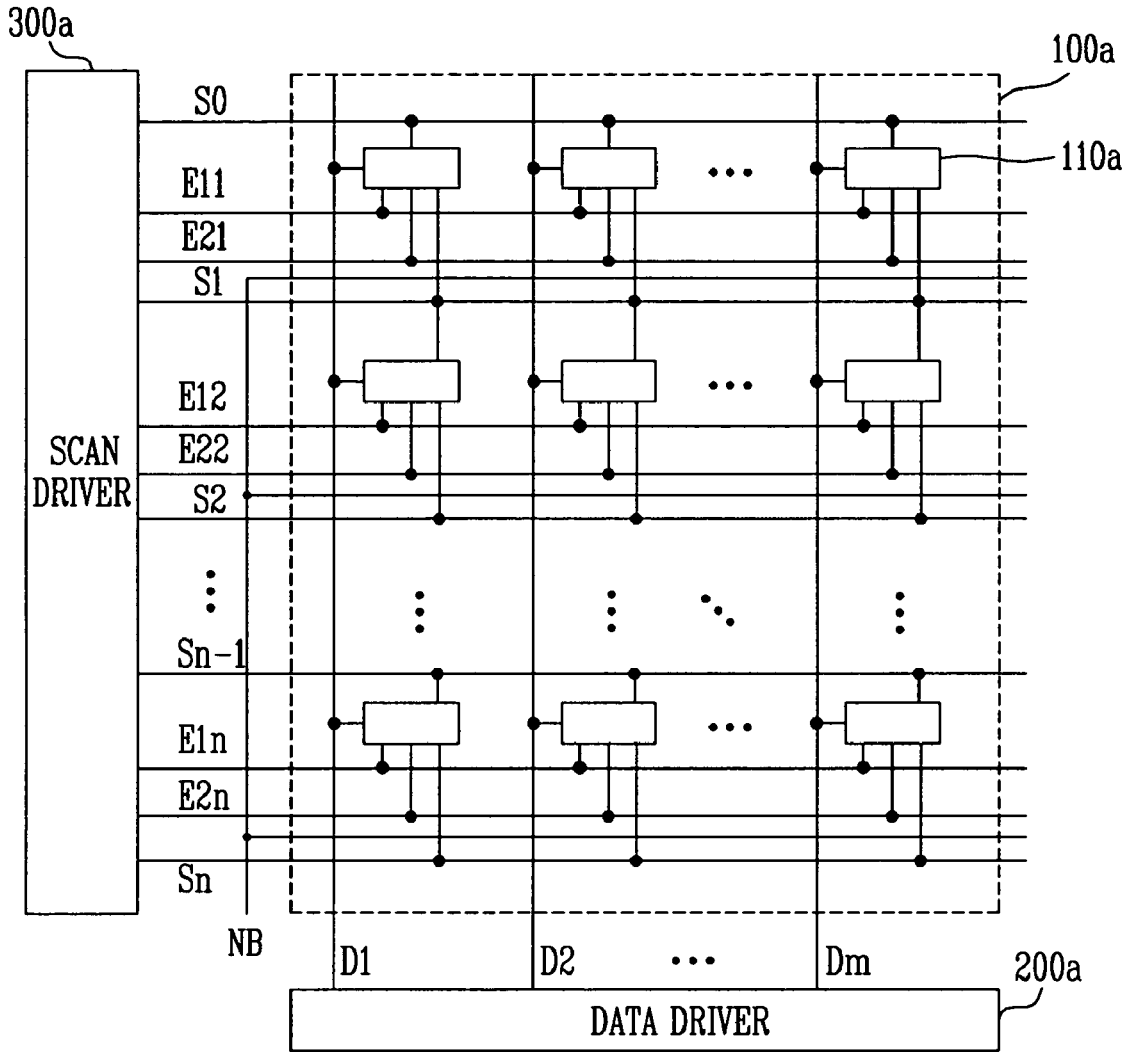
FIG. 3 illustrates a structure of a light emitting display according to a first embodiment of the present invention.

FIG. 3 illustrates a structure of a light emitting display according to a first embodiment of the present invention. Referring to FIG. 3, the light emitting display includes an image display unit 100*a*, a data driver 200*a*, and a scan driver 300*a*.

The image display unit 100*a* includes a plurality of pixels 110*a* including a plurality of organic light emitting diodes (OLEDs), a plurality of scan lines S0, S1 S2, . . . , Sn-1, and Sn arranged in a row direction, a plurality of first emission control lines E11, E12, . . . , E1*n*-1, and E1*n* and second emission control lines E21, E22, . . . , E2*n*-1, and E2*n* arranged in the row direction, a plurality of data lines D1, D2, . . . , Dm-1, and Dm arranged in a column direction, a plurality of pixel power source lines (not shown) for supplying pixel power from a pixel power source Vdd, and a reverse bias line NB that transmits a reverse bias voltage.

The pixels 110*a* receive scan signals through the scan lines S0, S1, S2, . . . , Sn-1, and Sn and generate driving currents corresponding to data signals (e.g., data voltages) transmitted from data lines D1, D2, . . . , Dm-1, and Dm. The driving currents are transmitted to the OLEDs in accordance with first and second emission control signals transmitted through the first emission control lines E11, E12, . . . , E1*n*-1, and E1*n* and the second emission control lines E21, E22, . . . , E2*n*-1, and E2*n* so that an image is displayed. Also, the OLEDs receive a reverse bias voltage from the reverse bias line NB while the OLEDs do not emit light so that it is possible to prevent the OLEDs from deteriorating and to thus prolong the life of the light emitting display.

The data driver 200*a* is connected to the data lines D1, D2, . . . , Dm-1, and Dm to transmit the data signals to the image display unit 100*a*.

The scan driver 300*a* is formed on a side of the image display unit 100*a* and is connected to the scan lines S0, S1, S2, . . . , Sn-1, and Sn, the first emission control lines E11, E12, . . . , E1*n*-1, and E1*n*, and the second emission control lines E21, E22, E2*n*-1, and E2*n* to transmit the scan signals and the first and second emission control signals to the image display unit 100*a*.

Figure 4:
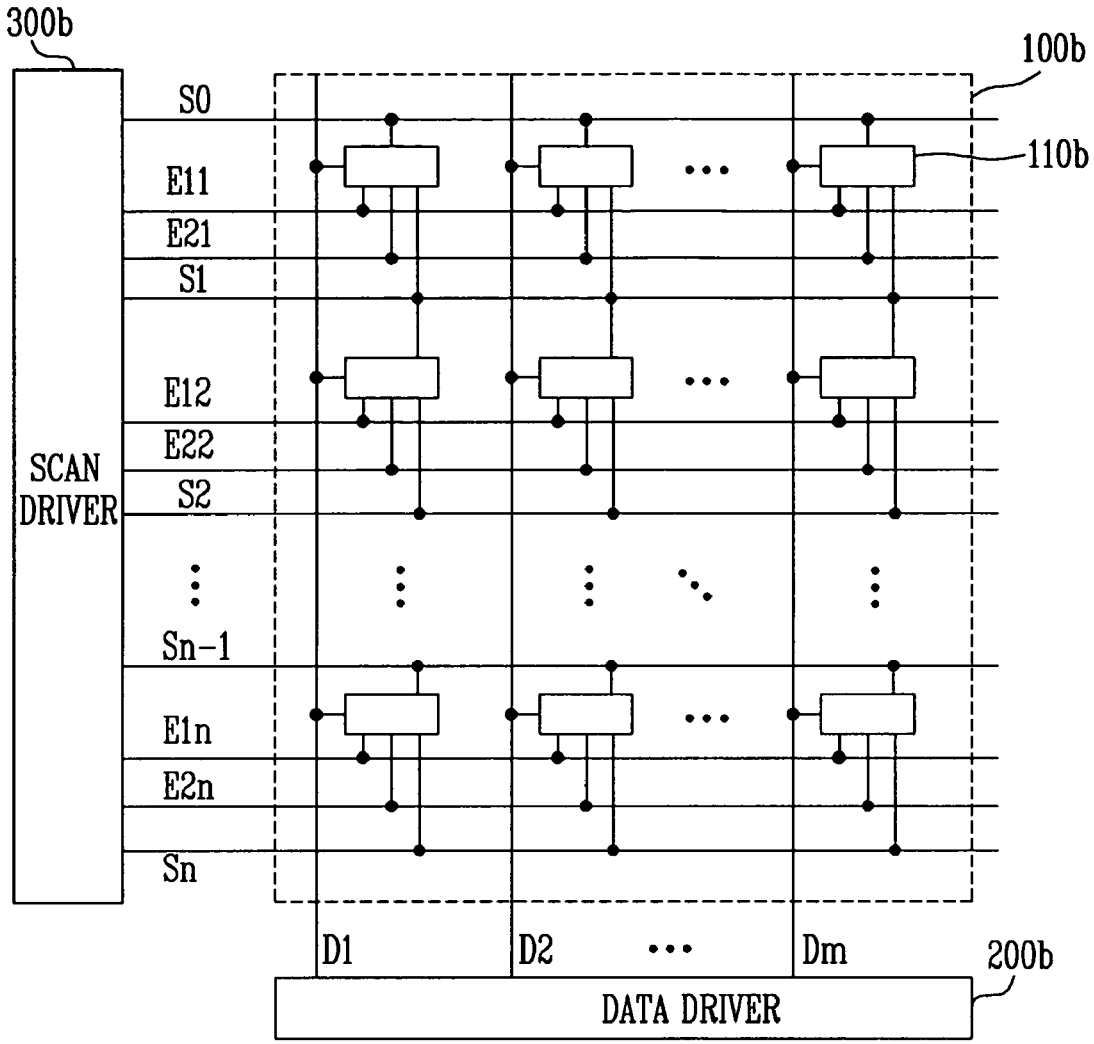
FIG. 4 illustrates a structure of a light emitting display according to a second embodiment of the present invention.

FIG. 4 illustrates a structure of a light emitting display according to a second embodiment of the present invention. Referring to FIG. 4, the light emitting display includes the image display unit 100*b*, the data driver 200*b*, and the scan driver 300*b*.

The image display unit 100*b* includes a plurality of pixels 110*b* including a plurality of organic light emitting diodes (OLEDs), the plurality of scan lines S0, S1, S2, . . . , Sn-1, and Sn arranged in a row direction, a plurality of first emission control lines E11, E12, . . . , E1*n*-1, and E1*n* and second emission control lines E21, E22, . . . , E2*n*-1, and E2*n* arranged in the row direction, a plurality of data lines D1, D2, . . . , Dm-1, and Dm arranged in a column direction, and the plurality of pixel power source lines (not shown) for supplying pixel power from a pixel power source Vdd.

The pixels 110*a* receive scan signals through the scan lines S0, S1, S2, . . . , Sn-1, and Sn and generate driving currents corresponding to the data signals (e.g., data voltages) transmitted from data lines D1, D2, . . . , Dm-1, and Dm. The driving currents are transmitted to the OLEDs in accordance with the first and second emission control signals transmitted through the first emission control lines E11, E12, . . . , E1*n*-1, and E1*n* and the second emission control lines E21, E22, . . . , E2*n*-1, and E2*n* so that an image is displayed. Also, in the embodiment of FIG. 4, one of the first and second emission control signals is used as the reverse bias voltage (e.g., a low voltage level) in the pixels 110*a* and is transmitted to at least one of the OLEDs when another one of the first and second emission control signals is in a high level (e.g., a high voltage level) so that the OLEDs are applied with the reverse voltage. Therefore, in the embodiment of FIG. 4, it is not necessary to include additional reverse bias lines so that the aperture ratio of the light emitting display does not have to be reduced by additional wiring lines.

The data driver 200*b* is connected to the data lines D1, D2, . . . , Dm-1, and Dm to transmit the data signals to the image display unit 100*b*.

The scan driver 300*b* is formed on a side of the image display unit 100*b* and is connected to the scan lines S0, S1, S2, . . . , Sn-1, and Sn, the first emission control lines E11, E12, . . . , E1*n*-1, and E1*n*, and the second emission control lines E21, E22, . . . , E2*n*-1, and E2*n* to transmit the scan signals and the first and second emission control signals to the image display unit 100*b*.

Figure 5:
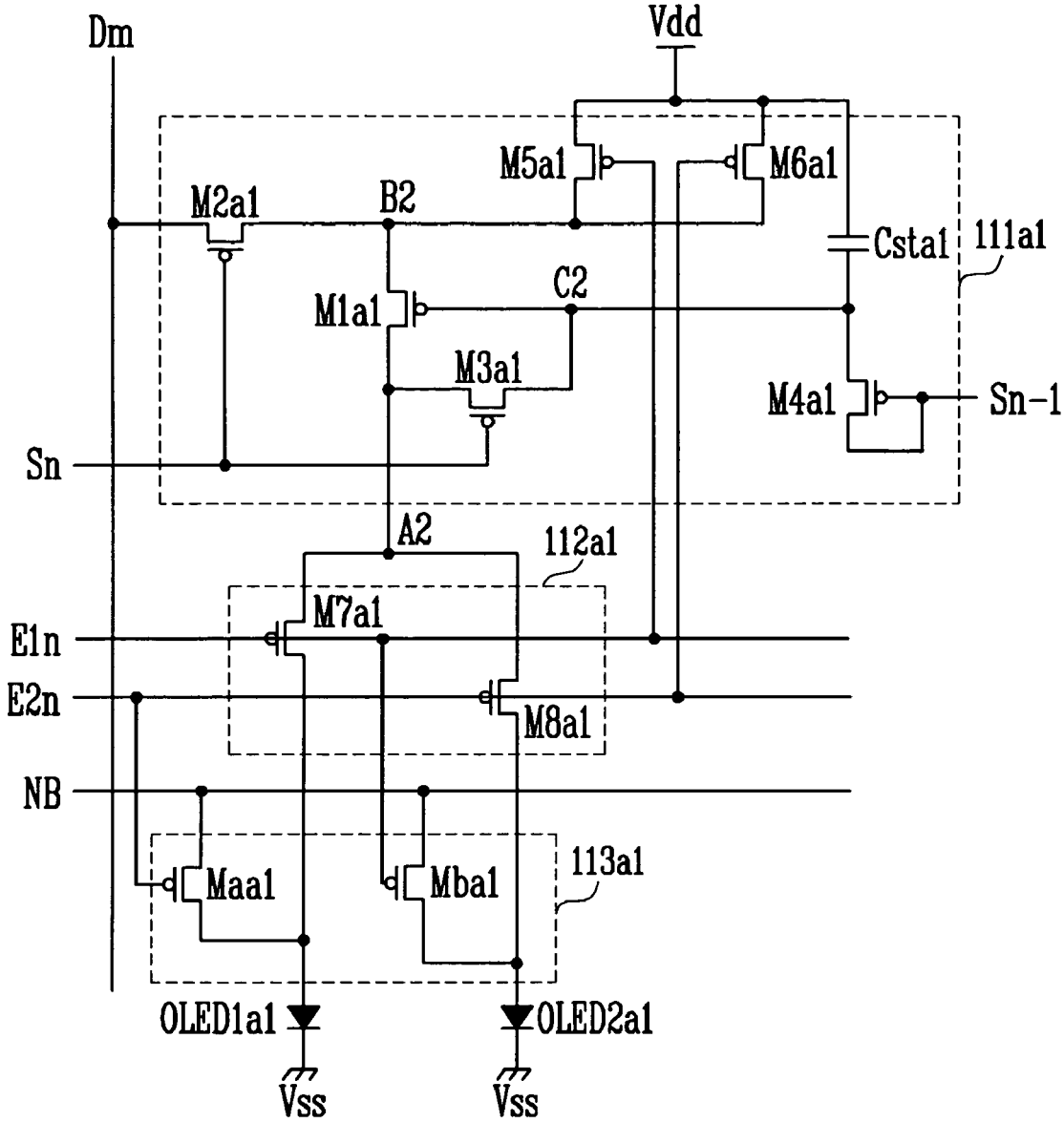
FIG. 5 is a circuit diagram illustrating a first embodiment of a pixel used with the light emitting display of FIG. 3.

FIG. 5 is a circuit diagram illustrating a first embodiment of a pixel used with the light emitting display of FIG. 3. Referring to FIG. 5, the pixel includes a pixel circuit that is composed of a driving circuit 111*a*1 including first to sixth transistors M1*a*1 to M6*a*1 and a capacitor Csta1, a switching circuit 112*a*1 including seventh and eighth transistors M7*a*1 and M8*a*1, and a reverse bias circuit 113*a*1 including first and second switching devices Maa1 and Mba1. The first to eighth transistors M1*a*1 to M8*a*1 and the first and second switching devices Maa1 and Mba1 are formed of PMOS transistors, and each transistor includes a source, a drain, and a gate. The capacitor Csta1 includes a first electrode and a second electrode. Since the drains and the sources of the first to eighth transistors M1*a*1 to M8*a*1 and the first and second switching devices Maa1 and Mba1 have no physical difference, each source and each drain may respectively be referred to as a first electrode and a second electrode.

The drain of the first transistor M1*a*1 is connected to the a first node A2, the source of the first transistor M1*a*1 is connected to a second node B2, and the gate of the first transistor M1*a*1 is connected to a third node C2 so that a current flows from the second node B2 to the first node A2 in accordance with a voltage of the third node C2.

The source of the second transistor M2*a*1 is connected to a data line Dm, the drain of the second transistor M2*a*1 is connected to the second node B2, and the gate of the second transistor M2*a*1 is connected to a first scan line Sn so that the second transistor M2*a*1 performs a switching operation in accordance with first scan signal sn transmitted through the first scan line Sn to selectively apply a data signal transmitted through the data line Dm to the second node B2.

The source of the third transistor M3*a*1 is connected to the first node A2, the drain of the third transistor M3*a*1 is connected to the third node C2, and the gate of the third transistor M3*a*1 is connected to the first scan line Sn so that the potential of the first node A2 is made equal to the potential of the third node C2 by the first scan signal sn transmitted through the first scan line Sn. Therefore, the first transistor M1*a*1 can serve as a diode for an electric current to flow through the first transistor M1*a*1 (in one direction).

The source and gate of the fourth transistor M4*a*1 are connected to a second scan line Sn-1, and the drain of the fourth transistor M4*a*1 is connected to the third node C2 so that the fourth transistor M4*a*1 transmits an initializing signal to the third node C2. The initial signal is a second scan signal sn-1 input to select the row that precedes by one row the row to which the first scans signal sn is input to select. The second scan signal sn-1 is transmitted through the second scan line Sn-1. The second scan line Sn-1 is the scan line connected to the row that precedes the row to which the first scan line Sn is connected by one row.

The source of the fifth transistor M5*a*1 is connected to a pixel power source line of a pixel power source Vdd, the drain of the fifth transistor M5*a*1 is connected to the second node B2, and the gate of the fifth transistor M5*a*1 is connected to a first emission control line E1*n* so that the fifth transistor M5*a*1 selectively applies a pixel power of the pixel power source Vdd to the second node B2 in accordance with a first emission control signal e1*n* transmitted through the first emission control line E1*n*.

The source of the sixth transistor M6*a*1 is connected to the pixel power source line of the pixel power source Vdd, the drain of the sixth transistor M6*a*1 is connected to the second node B2, and the gate of the sixth transistor M6*a*1 is connected to a second emission control line E2*n* so that the sixth transistor M6*a*1 selectively applies the pixel power of the pixel power source Vdd to the second node B2 in accordance with a second emission control signal e2*n* transmitted through the second emission control line E2*n*.

The source of the seventh transistor M7*a*1 is connected to the first node A2, the drain of the seventh transistor M7*a*1 is connected to a first OLED OLED1*a*1, and the gate of the seventh transistor M7*a*1 is connected to the first emission control line E1*n* so that the seventh transistor M7*a*1 selectively applies the current that flows through the first node A2 to the first OLED OLED1*a*1 in accordance with the first emission control signal e1*n* transmitted through the first emission control signal E1*n* to emit light from the first OLED OLED1*a*1.

The source of the eighth transistor M8*a*1 is connected to the first node A2, the drain of the eighth transistor M8*a*1 is connected to a second OLED OLED2*a*1, and the gate of the eighth transistor M8*a*1 is connected to the second emission control line E2*n* so that the eighth transistor M8*a*1 applies the current that flows through the first node A2 to the second OLED OLED2*a*1 in accordance with the second emission control signal e2*n* transmitted through the second emission control line E2*n* to emit light from the second OLED OLED2*a*1.

The source of the first switching device Maa1 is connected to a reverse bias line NB, the drain of the first switching device Maa1 is connected to the first OLED OLED1*a*1, and the gate of the first switching device Maa1 is connected to the second emission control line E2*n* so that the first switching device Maa1 applies a reverse bias signal transmitted through the reverse bias line NB to the first OLED OLED1*a*1 in accordance with the second emission control signal e2*n* transmitted through the second emission control line E2*n* to apply the reverse voltage to the first OLED OLED1*a*1.

The source of the second switching device Mba1 is connected to the reverse bias line NB, the drain of the second switching device Mba1 is connected to the second OLED OLED2*a*1, and the gate of the second switching device Mba1 is connected to the first emission control line E1*n* so that the second switching device Mba1 applies the reverse bias signal transmitted through the reverse bias line NB to the second OLED OLED2*a*1 in accordance with the first emission control signal e1*n* transmitted through the first emission control line E1*n* to apply the reverse voltage to the second OLED OLED2*a*1.

The first electrode of the capacitor Csta1 is connected to the pixel power source line of the pixel power source Vdd and the second electrode of the capacitor Csta1 is connected to the third node C2 so that the capacitor Csta1 is initialized by the initializing signal transmitted to the third node C2 through the fourth transistor M4*a*1, and the voltage corresponding to the data signal is stored in the capacitor Csta1 and is transmitted to the third node C2. Therefore, the gate voltage of the first transistor M1*a*1 is maintained for a predetermined time by the capacitor Csta1.

Figure 6:
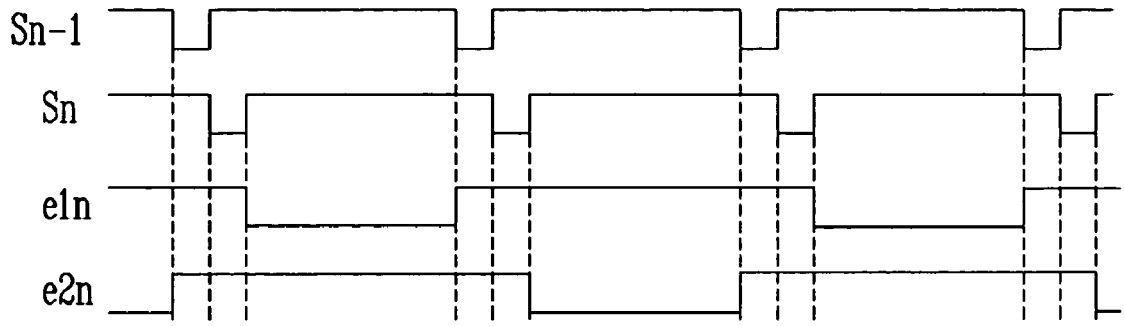
FIG. 6 illustrates waveforms for operating the pixel of FIG. 5.

FIG. 6 illustrates waveforms for operating the pixel of FIG. 5. Referring to FIG. 6, the pixel is operated by the first and second scan signals sn and sn-1, the data signal, the first and second emission control signals e1*n* and e2*n*, and the reverse bias signal (not shown). The first and second scan signals sn and sn-1 and the first and second emission control signals e1*n* and e2*n* are periodic signals and the second scan signal sn-1 is a scan signal transmitted to a scan line that precedes the scan line to which the first scan signal sn is transmitted.

In operation, the fourth transistor M4*a*1 is first turned on by the second scan signal sn-1 and the second scan signal sn-1 is transmitted to the capacitor Csta1 through the fourth transistor M4*a*1 so that the capacitor Csta1 is initialized.

The second and third transistors M2*a*1 and M3*a*1 are then turned on by the first scan signal sn so that the potential of the second node B2 is made equal to the potential of the third node C2. Therefore, the first transistor M1*a*1 is connected like a diode so that an electric current can flow through the first transistor M1*a*1. In addition, the data signal is transmitted to the second node B2 through the second transistor M2*a*1. Therefore, the data signal is applied to the second electrode of the capacitor Csta1 through the second transistor M2*a*1, the first transistor M1*a*1, and the third transistor M3*a*1 so that the voltage corresponding to difference between the data signal and the threshold voltage is applied to the second electrode of the capacitor Csta1.

After the first scan signal sn is transited to the high level, when the first emission control signal e1*n* is transited to the low level and is maintained in the low level for a predetermined (and/or uniform) period, the fifth and seven transistors M5*a*1 and M7*a*1 are turned on by the first emission control signal e1*n* so that the voltage corresponding to EQUATION 1 is applied between the gate and source of the first transistor M1*a*1.

$$Vgs = Vdd - (V\text{data} - |Vth|) \quad \text{[EQUATION 1]}$$

wherein, Vgs, Vdd, Vdata, and Vth represent the voltage between the source and the gate of the first transistor M1*a*1, a pixel power source voltage, the voltage of the data signal, and the threshold voltage of the first transistor M1*a*1, respectively.

Therefore, the current obtained by EQUATION 2 flows to the first node A2.

$$I = \frac{\beta}{2}(Vgs - |Vth|)^2 = \frac{\beta}{2}(Vdata - Vdd + Vth - Vth)^2 = \frac{\beta}{2}(Vdata - Vdd)^2 \quad \text{[EQUATION 2]}$$

wherein, I, Vgs, Vdd, Vth, and Vdata represent the current that flows through the OLED OLED1*a*1, the voltage between the source and the gate of the first transistor M1*a*1, the voltage of the pixel power source, the threshold voltage of the first transistor M1*a*1, and the voltage of the data signal, respectively.

Therefore, the current flows to the first node A2 regardless of the threshold voltage of the first transistor M1*a*1.

At this time, since the second emission control signal e2*n* is in the high level, the first switching device Maa1 is maintained at a turned off state by the second emission control signal e2*n* so that the reverse bias signal (e.g., a reverse bias voltage) transmitted through the reverse bias line NB connected to the source of the first switching device Maa1 is not transmitted to the first OLED OLED1*a*1. On the other hand, the second switching device Mba1 is turned on by the first emission control signal e1*n* so that the reverse bias signal or voltage transmitted through the reverse bias line NB connected to the source of the second switching device Mba1 is transmitted to the second OLED OLED2*a*1. Therefore, the second OLED OLED2*a*1 is reverse biased.

Next, the voltage value corresponding to difference between the pixel power source and the data signal is stored in the capacitor Csta1 by the first and second scan signals sn and sn-1 and the data signal, the voltage corresponding to the EQUATION 1 is transmitted between the source and gate of the first transistor M1*a*1, the sixth and eighth transistors M6*a*1 and M8*a*1 are turned on by the second emission control signal e2*n*, and the current corresponding to the EQUATION 2 flows to the second OLED OLED2*a*1.

At this time, since the second emission control signal e2*n* is in the low level, the first switching device Maa1 is maintained at a turned-on state by the second emission control signal e2*n* so that the reverse bias signal or voltage transmitted through the reverse bias line NB connected to the source of the first switching device Maa1 is transmitted to the first OLED OLED1*a*1. Therefore, the first OLED OLED1*a*1 is reverse biased. On the other hand, the second switching device Mba1 is turned off by the first emission control signal e1*n* so that the reverse bias signal or voltage is not transmitted through the reverse bias line NB connected to the source of the second switching device Mba1.

Figure 7:
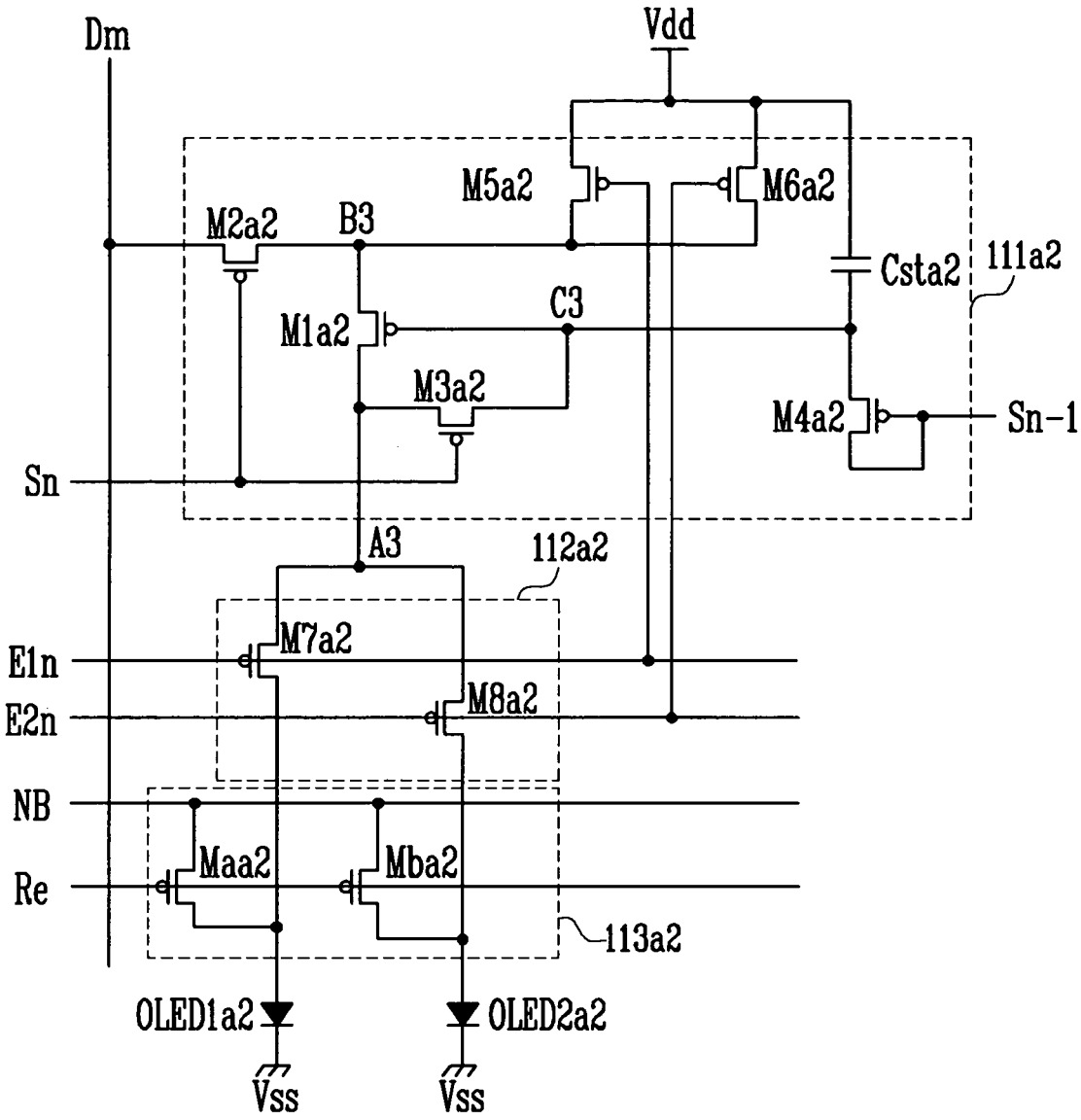
FIG. 7 is a circuit diagram illustrating a second embodiment of a pixel used with the light emitting display of FIG. 3.

FIG. 7 is a circuit diagram illustrating a second embodiment of a pixel used with the light emitting display of FIG. 3. Referring to FIG. 7, the pixel is composed of a pixel circuit and first and second organic light emitting diodes OLED1*a*2 and OLED2*a*2. The pixel circuit is composed of a driving circuit 111*a*2 including first to sixth transistors M1*a*2 to M6*a*2 and a capacitor Csta2, a switching circuit 112*a*2 including seventh and eighth transistors M7*a*2 and M8*a*2, and a reverse bias circuit 113*a*2 including first and second switching devices Maa2 and Mba2. The first to eighth transistors M1*a*2 to M8*a*2 and the first and second switching devices Maa2 and Mba2 are formed of PMOS transistors and each transistor includes a source, a drain, and a gate. The capacitor Csta2 includes a first electrode and a second electrode. Since the drains and the sources of the first to eighth transistors M1*a*2 to M8*a*2 and the first and second switching devices Maa2 and Mba2 have no physical difference, each source and each drain may respectively be referred to as a first electrode and a second electrode.

The drain of the first transistor M1*a*2 is connected to a first node A3, the source of the first transistor M1*a*2 is connected to a second node B3, and the gate of the first transistor M1*a*2 is connected to a third node C3 so that a current flows from the second node B3 to the first node A3 in accordance with a voltage of the third node C3.

The source of the second transistor M2*a*2 is connected to a data line Dm, the drain of the second transistor M2*a*2 is connected to the second node B3, and the gate of the second transistor M2*a*2 is connected to a first scan line Sn so that the second transistor M2*a*2 performs a switching operation in accordance with a first scan signal sn transmitted through the first scan line Sn to selectively apply a data signal transmitted through the data line Dm to the second node B3.

The source of the third transistor M3*a*2 is connected to the first node A3, the drain of the third transistor M3*a*2 is connected to the third node C3, and the gate of the third transistor M3*a*2 is connected to the first scan line Sn so that the potential of the first node A3 is made equal to the potential of the third node C3 by the first scan signal sn transmitted through the first scan line Sn. Therefore, the first transistor M1*a*2 can be connected as a diode for an electric current to flow through the first transistor M1*a*2.

The source and gate of the fourth transistor M4*a*2 are connected to a second scan line Sn-1 and the drain of the fourth transistor M4*a*2 is connected to the third node C3 so that the fourth transistor M4*a*2 transmits an initializing signal to the third node C3. The initial signal is a second scan signal sn-1 input to select the row that precedes by one row the row to which the first scans signal sn is input to select. The second scan signal sn-1 is transmitted through the second scan line Sn-1. The second scan line Sn-1 is the scan line connected to the row that precedes the row to which the first scan line Sn is connected by one row.

The source of the fifth transistor M5*a*2 is connected to a pixel power source line of a pixel power source Vdd, the drain of the fifth transistor M5*a*2 is connected to the second node B3, and the gate of the fifth transistor M5*a*2 is connected to a first emission control line E1*n* so that the fifth transistor M5*a*2 selectively applies a pixel power of the pixel power source Vdd to the second node B3 in accordance with a first emission control signal e1*n* transmitted through the first emission control line E1*n*.

The source of the sixth transistor M6*a*2 is connected to the pixel power source line of the pixel power source Vdd, the drain of the sixth transistor M6*a*2 is connected to the second node B3, and the gate of the sixth transistor M6*a*2 is connected to a second emission control line E2*n* so that the sixth transistor M6*a*2 selectively applies the pixel power of the pixel power source Vdd to the second node B3 in accordance with a second emission control signal e2*n* transmitted through the second emission control line E2*n*.

The source of the seventh transistor M7*a*2 is connected to the first node A3, the drain of the seventh transistor M7*a*2 is connected to a first OLED OLED1*a*2, and the gate of the seventh transistor M7*a*2 is connected to the first emission control line E1*n* so that the seventh transistor M7*a*2 selectively applies the current that flows through the first node A3 to the first OLED OLED1*a*2 in accordance with the first emission control signal e1*n* transmitted through the first emission control signal E1*n* to emit light from the first OLED OLED1*a*2.

The source of the eighth transistor M8*a*2 is connected to the first node A3, the drain of the eighth transistor M8*a*2 is connected to a second OLED OLED2*a*2, and the gate of the eighth transistor M8*a*2 is connected to the second emission control line E2*n* so that the eighth transistor M8*a*2 applies the current that flows through the first node A3 to the second OLED OLED2*a*2 in accordance with the second emission control signal e2*n* transmitted through the second emission control line E2*n* to emit light from the second OLED OLED2*a*2.

The source of the first switching device Maa2 is connected to a reverse bias line NB, the drain of the first switching device Maa2 is connected to the first OLED OLED1*a*2, and the gate of the first switching device Maa2 is connected to a reverse bias control line Re so that the first switching device Maa2 applies a reverse bias signal transmitted through the reverse bias line NB to the first OLED OLED1*a*2 in accordance with a reverse bias control signal re transmitted through the reverse bias control line Re to apply the reverse voltage to the first OLED OLED1*a*2.

The source of the second switching device Mba2 is connected to the reverse bias line NB, the drain of the second switching device Mba2 is connected to the second OLED OLED2*a*2, and the gate of the second switching device Mba2 is connected to the reverse bias control line Re so that the second switching device Mba2 applies the reverse bias signal transmitted through the reverse bias line NB to the second OLED OLED2*a*2 in accordance with the reverse bias control signal re transmitted through the reverse bias control line Re to apply the reverse voltage to the second OLED OLED2*a*2.

The first electrode of the capacitor Csta2 is connected to the pixel power source line of the pixel power source Vdd, the second electrode of the capacitor Csta2 is connected to the third node C3 so that the capacitor Csta2 is initialized by the initializing signal transmitted to the third node C3 through the fourth transistor M4*a*2, and the voltage corresponding to the data signal is stored in the capacitor Csta2 and is transmitted to the third node C3. Therefore, the gate voltage of the first transistor M1*a*2 is maintained for a predetermined time by the capacitor Csta2.

Figure 8:
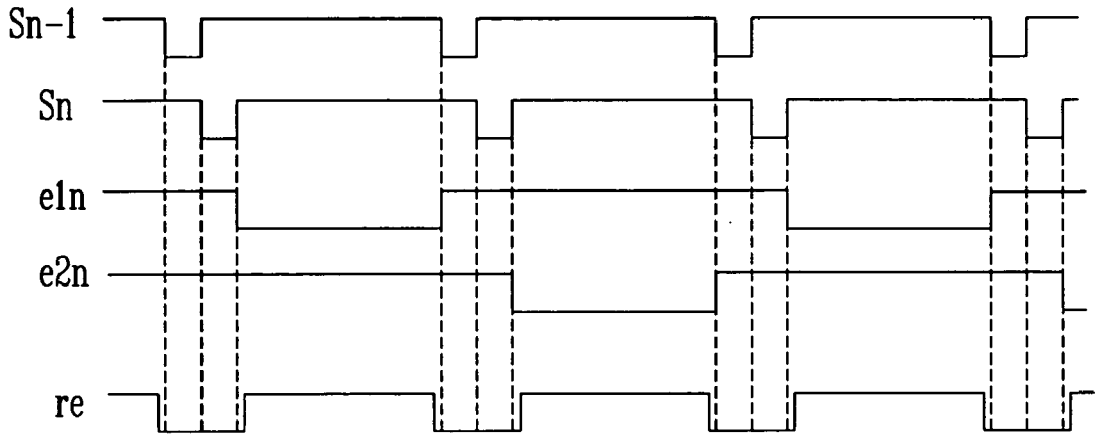
FIG. 8 illustrates waveforms for operating of the pixel of FIG. 7.

FIG. 8 illustrates waveforms for operating the pixel of FIG. 7. Referring to FIG. 8, the pixel is operated by the first and second scan signals sn and sn-1, the data signal, the first and second emission control signals e1*n* and e2*n*, the reverse bias signal (not shown), and the reverse bias control signal re. The first and second scan signals sn and sn-1, the first and second emission control signals e1*n* and e2*n*, and the reverse bias control signal re are periodic signals. The second scan signal sn-1 is a scan signal transmitted to a scan line that precedes the scan line to which the first scan signal sn is transmitted.

As shown in FIG. 8, when the reverse bias control signal re is in the high level, the first and second switching devices Maa2 and Mba2 are turned off so that the reverse bias signal is not transmitted to the first and second OLEDs OLED1*a*2 and OLED2*a*2. Therefore, when a current flows to the first OLED OLED1*a*2 or the second OLED OLED2*a*2, the reverse bias signal is not applied.

When the current does not flow to the first OLED OLED1*a*2 and the second OLED OLED2*a*2, since the reverse bias control signal re is in the low level, the first and second switching devices Maa2 and Mba2 are turned on so that the reverse bias signal or voltage is transmitted to the first and second OLEDs OLED1*a*2 and OLED2*a*2. Therefore the reverse bias voltage is applied to the first and second OLEDs OLED1*a*2 and OLED2*a*2.

Figure 9:
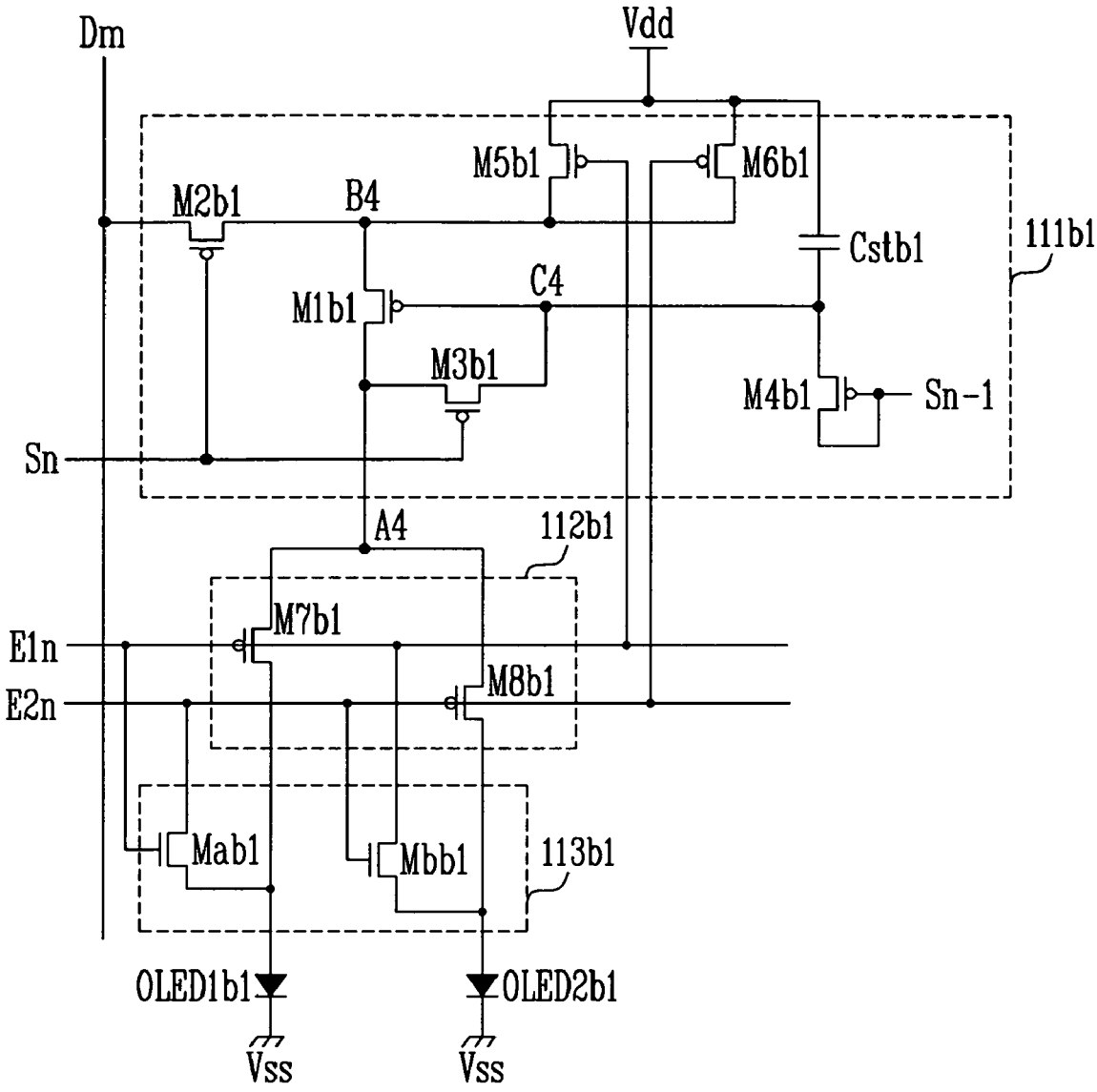
FIG. 9 is a circuit diagram illustrating a first embodiment of a pixel used with the light emitting display of FIG. 4.

FIG. 9 illustrates a first embodiment of a pixel used with the light emitting display of FIG. 4. Referring to FIG. 9, the pixel includes a pixel circuit that is composed of a driving circuit 111*b*1 including first to sixth transistors M1*b*1 to M6*b*1 and a capacitor Cstb1, a switching circuit 112*b*1 including seventh and eighth transistors M7*b*1 and M8*b*1, and a reverse bias circuit 113*b*1 including first and second switching devices Mab1 and Mbb1. The first to eighth transistors M1*b*1 to M8*b*1 are formed of PMOS transistors and the first and second switching devices Mab1 and Mbb1 are formed of NMOS transistors. Each transistor includes a source, a drain, and a gate.

The capacitor Cstb1 includes a first electrode and a second electrode. Since the drains and the sources of the first to eighth transistors M1*b*1 to M8*b*1 and the first and second switching devices Mab1 and Mbb1 have no physical difference, each source and each drain may respectively be referred to as a first electrode and a second electrode.

The drain of the first transistor M1*b*1 is connected to a first node A4, the source of the first transistor M1*b*1 is connected to a second node B4, and the gate of the first transistor M1*b*1 is connected to a third node C4 so that a current flows from the second node B4 to the first node A4 in accordance with a voltage of the third node C4.

The source of the second transistor M2*b*1 is connected to a data line Dm, the drain of the second transistor M2*b*1 is connected to the second node B4, and the gate of the second transistor M2*b*1 is connected to a first scan line Sn so that the second transistor M2*b*1 performs a switching operation in accordance with a first scan signal sn transmitted through the first scan line Sn to selectively apply a data signal transmitted through the data line Dm to the second node B4.

The source of the third transistor M3*b*1 is connected to the first node A4, the drain of the third transistor M3*b*1 is connected to the third node C4, and the gate of the third transistor M3*b*1 is connected to the first scan line Sn so that the potential of the first node A4 is made equal to the potential of the third node C4 by the first scan signal sn transmitted through the first scan line Sn. Therefore, the first transistor M1*b*1 can be connected like a diode for an electric current to flow through the first transistor M1*b*1.

The source and gate of the fourth transistor M4*b*1 are connected to a second scan line Sn-1 and the drain of the fourth transistor M4*b*1 is connected to the third node C4 so that the fourth transistor M4*b*1 transmits an initializing signal to the third node C4. The initial signal is a second scan signal sn-1 input to select the row that precedes by one row the row to which the first scans signal sn is input to select. The second scan sn-1 is transmitted through the second scan line Sn-1. The second scan line Sn-1 is the scan line connected to the row that precedes the row to which the first scan line Sn is connected by one row.

The source of the fifth transistor M5*b*1 is connected to a pixel power source line of the pixel power source Vdd, the drain of the fifth transistor M5*b*1 is connected to the second node B4, and the gate of the fifth transistor M5*b*1 is connected to a first emission control line E1*n* so that the fifth transistor M5*b*1 selectively applies a pixel power of the pixel power source Vdd to the second node B4 in accordance with a first emission control signal e1*n* transmitted through the first emission control line E1*n*.

The source of the sixth transistor M6*b*1 is connected to the pixel power source line of the pixel power source Vdd, the drain of the sixth transistor M6*b*1 is connected to the second node B4, and the gate of the sixth transistor M6*b*1 is connected to a second emission control line E2*n* so that the sixth transistor M6*b*1 selectively applies the pixel power of the pixel power source Vdd to the second node B4 in accordance with a second emission control signal e2*n* transmitted through the second emission control line E2*n*.

The source of the seventh transistor M7*b*1 is connected to the first node A4, the drain of the seventh transistor M7*b*1 is connected to a first OLED OLED1*b*1, and the gate of the seventh transistor M7*b*1 is connected to the first emission control line E1*n* so that the seventh transistor M7*b*1 selectively applies the current that flows through the first node A4 to the first OLED OLED1*b*1 in accordance with the first emission control signal e1*n* transmitted through the first emission control signal E1*n* to emit light from the first OLED OLED1*b*1.

The source of the eighth transistor M8*b*1 is connected to the first node A4, the drain of the eighth transistor M8*b*1 is connected to a second OLED OLED2*b*1, and the gate of the eighth transistor M8*b*1 is connected to the second emission control line E2*n* so that the eighth transistor M8*b*1 applies current that flows through the first node A4 to the second OLED OLED2*b*1 in accordance with the second emission control signal e2*n* transmitted through the second emission control line E2*n* to emit light from the second OLED OLED2*b*1.

The source of the first switching device Mab1 is connected to the second emission control line E2*n*, the drain of the first switching device Mab1 is connected to the first OLED OLED1*b*1, and the gate of the first switching device Mab1 is connected to the first emission control line E1*n* so that the first switching device Mab1 applies the second emission control signal e2*n* transmitted through the second emission control line E2*n* to the first OLED OLED1*b*1 in accordance with the first emission control signal e1*n* transmitted through the first emission control line E1*n*. At this time, when the first emission control signal e1*n* transmitted through the first emission control line E1*n* is in the high level, the first switching device Mab1 is turned on, and the second emission control signal e2*n* is in the low level so that the potential of the anode electrode of the first OLED OLED1*b*1 is lower than the potential of the cathode electrode. Therefore, the first OLED OLED1*b*1 is reverse biased.

The source of the second switching device Mbb1 is connected to the first emission control line E1*n*, the drain of the second switching device Mbb1 is connected to the second OLED OLED2*b*1, and the gate of the second switching device Mbb1 is connected to the second emission control line E2*n* so that the switching device Mbb1 applies the first emission control signal e1*n* transmitted through the first emission control line E1*n* to the second OLED OLED2*b*1 in accordance with the second emission control signal e2*n* transmitted through the second emission control line E2*n*. At this time, when the second emission control signal e2*n* transmitted through the second emission control line E2*n* is in the high level, the second switching device Mbb1 is turned on and the first emission control signal e1*n* is in the low level so that the potential of the anode electrode of the second OLED OLED2*b*1 is lower than the potential of the cathode electrode. Therefore, the second OLED OLED2*b*1 is reverse biased.

The seventh and eighth transistors M7*b*1 and M8*b*1 are formed of the PMOS transistors, and the first and second switching devices Mab1 and Mbb1 are formed of the NMOS transistors so that the seventh transistor M7*b*1 and the first switching device Mab1 are turned on or off at different times by the first emission control signal e1*n* and so that the eighth transistor M8*b*1 and the second switching device Mbb1 are turned on or off at different times by the second emission control signal e2*n*.

The first electrode of the capacitor Cstb1 is connected to the pixel power source line of the pixel power source Vdd and the second electrode of the capacitor Cstb1 is connected to the third node C4 so that the capacitor Cstb1 is initialized by the initializing signal transmitted to the third node C4 through the fourth transistor M4*b*1 and so that the voltage corresponding to the data signal is stored in the capacitor Cstb1 and is transmitted to the third node C4. Therefore, the gate voltage of the first transistor M1*b*1 is maintained for a predetermined time by the capacitor Cstb1.

Figure 10:
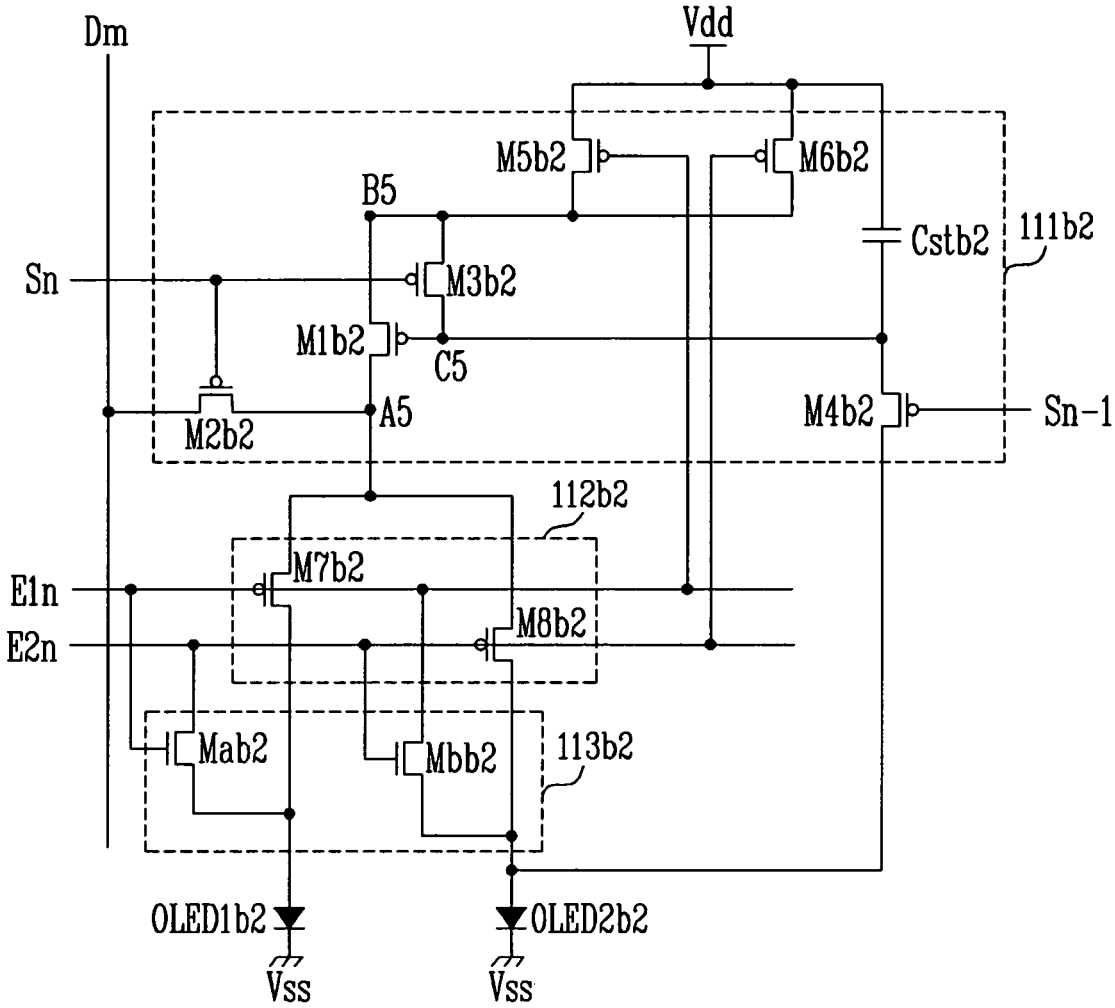
FIG. 10 is a circuit diagram illustrating a second embodiment of a pixel used with the light emitting display of FIG. 4.

FIG. 10 is a circuit diagram illustrating a second embodiment of a pixel used with the light emitting display of FIG. 4. Referring to FIG. 10, the pixel includes a pixel circuit that is composed of a driving circuit 111*b*2 including first to sixth transistors M1*b*2 to M6*b*2 and a capacitor Cstb2, a switching circuit 112*b*2 including seventh and eighth transistors M7*b*2 and M8*b*2, and a reverse bias circuit 113*b*2 including first and second switching devices Mab2 and Mbb2. The first to eighth transistors M1*b*2 to M8*b*2 are formed of the PMOS transistors, and the first and second switching devices Mab2 and Mbb2 are formed of the NMOS transistor. Each transistor includes a source, a drain, and a gate.

The capacitor Cstb2 includes a first electrode and a second electrode. Since the drains and the sources of the first to eighth transistors M1*b*2 to M8*b*2 and the first and second switching devices Mab2 and Mbb2 have no physical difference, each source and each drain may respectively be referred to as a first electrode and a second electrode.

The drain of the first transistor M1*b*2 is connected to a first node A5, the source of the first transistor M1*b*2 is connected to a second node B5, and the gate of the first transistor M1*b*2 is connected to a third node C5 so that a current flows from the second node B5 to the first node A5 in accordance with a voltage of the third node C5.

The source of the second transistor M2*b*2 is connected to a data line Dm, the drain of the second transistor M2*b*2 is connected to the first node A5, and the gate of the second transistor M2*b*2 is connected to the first scan line Sn so that the second transistor M2*b*2 performs a switching operation in accordance with a first scan signal sn transmitted through the first scan line Sn to selectively apply a data signal transmitted through the data line Dm to the first node A5.

The source of the third transistor M3*b*2 is connected to the second node B5, the drain of the third transistor M3*b*2 is connected to the third node C5, and the gate of the third transistor M3*b*2 is connected to the first scan line Sn so that the potential of the second node B5 is made equal to the potential of the third node C5 by the first scan signal sn transmitted through the first scan line Sn. Therefore, the first transistor M1*b*2 can serve as a diode for an electric current to flow through the first transistor M1*b*2.

The source of the fourth transistor M4*b*2 is connected to an anode electrode of an OLED2*b*2, the drain of the fourth transistor M4*b*2 is connected to the third node C5, and the gate of the fourth transistor M4*b*2 is connected to a second scan line Sn-1 so that the fourth transistor M4*b*2 applies a voltage to the third node C5 when no current flows to the first and second OLEDs OLED1*b*2 and OLED2*b*2 to the third node C5 in accordance with a second scan signal sn-1. At this time, the voltage applied by the fourth transistor M4b2 to the third node C5 in accordance with the second scan signal sn-1 is used as an initializing signal for initializing the capacitor Cstb2.

The source of the fifth transistor M5b2 is connected to a pixel power source line of the pixel power source Vdd, the drain of the fifth transistor M5b2 is connected to the second node B5, and the gate of the fifth transistor M5b2 is connected to a first emission control line E1n so that the fifth transistor M5b2 selectively applies a pixel power of the pixel power source Vdd to the second node B5 in accordance with a first emission control signal e1n transmitted through the first emission control line E1n.

The source of the sixth transistor M6b2 is connected to the pixel power source line of the pixel power source Vdd, the drain of the sixth transistor M6b2 is connected to the second node B5, and the gate of the sixth transistor M6b2 is connected to a second emission control line E2n so that the sixth transistor M6b2 selectively applies the pixel power of the pixel power source Vdd to the second node B5 in accordance with a second emission control signal e2n transmitted through the second emission control line E2n.

The source of the seventh transistor M7b2 is connected to the first node A5, the drain of the seventh transistor M7b2 is connected to a first OLED OLED1b2, and the gate of the seventh transistor M7b2 is connected to the first emission control line E1n so that the seventh transistor M7b2 selectively applies the current that flows through the first node A5 to the first OLED OLED1b2 in accordance with the first emission control signal e1n transmitted through the first emission control signal E1n to emit light from the first OLED OLED1b2.

The source of the eighth transistor M8b2 is connected to the first node A5, the drain of the eighth transistor M8b2 is connected to a second OLED OLED2b2, and the gate of the eighth transistor M8b2 is connected to the second emission control line E2n so that the eighth transistor M8b2 applies the current that flows through the first node A5 to the second OLED OLED2b2 in accordance with the second emission control signal e2n transmitted through the second emission control line E2n to emit light from the second OLED OLED2b2.

The source of the first switching device Mab2 is connected to the second emission control line E2n, the drain of the first switching device Mab2 is connected to the first OLED OLED1b2, and the gate of the first switching device Mab2 is connected to the first emission control line E1n so that the first switching device Mab2 is turned on when the first emission control signal e1n transmitted through the first emission control line E1n is in the high level. At this time, the second emission control signal e2n is in the low level so that the potential of the anode electrode of the first OLED OLED1b2 is lower than the potential of the cathode electrode. Therefore, the first OLED OLED1b2 is reverse biased.

The source of the second switching device Mbb2 is connected to the first emission control line E1n, the drain of the second switching device Mbb2 is connected to the second OLED OLED2b2, and the gate of the second switching device Mbb2 is connected to the second emission control line E2n so that the switching device Mbb2 is turned on when the second emission control signal e2n transmitted through the second emission control line E2n is in the high level. At this time, the first emission control signal e1n is in the low level so that the potential of the anode electrode of the first OLED OLED1b2 is lower than the potential of the cathode electrode. Therefore, the first OLED OLED1b2 is reverse biased.

In more detail, the source of the first switching device Mab2 is connected to the second emission control line E2n, the drain of the first switching device Mab2 is connected to the first OLED OLED1b2, and the gate of the first switching device Mab2 is connected to the first emission control signal e1n so that the first switching device Mab2 applies the second emission control signal e2n transmitted through the second emission control line E2n to the first OLED OLED1b2 in accordance with the first emission control signal e1n transmitted through the first emission control line E1n. At this time, when the first emission control signal e1n transmitted through the first emission control line E1n is in the high level, the first switching device Mab2 is turned on and the second emission control signal e2n is in the low level so that the potential of the anode electrode of the first OLED OLED1b2 is lower than the potential of the cathode electrode. Therefore, the first OLED OLED1b2 is reverse biased.

The source of the second switching device Mbb2 is connected to the first emission control line E1n, the drain of the second switching device Mbb2 is connected to the second OLED OLED2b2, and the gate of the second switching device Mbb2 is connected to the second emission control line E2n so that the second switching device Mbb2 applies the first emission control signal e1n transmitted through the first emission control signal E1n to the second OLED OLED2b2 in accordance with the second emission control signal e2n transmitted through the second emission control line E2n. At this time, when the second emission control signal e2n transmitted through the second emission control line E2n is in the high level, the second switching device Mbb2 is turned on, and the first emission control signal e1n is in the low level so that the potential of the anode electrode of the second OLED OLED2b2 is lower than the potential of the cathode electrode. Therefore, the second OLED OLED2b2 is reverse biased.

The seventh and eighth transistors M7b2 and M8b2 are formed of the PMOS transistors, and the first and second switching devices Mab2 and Mbb2 are formed of the NMOS transistors so that the seventh transistor M7b2 and the first switching device Mab2 are turned on or off at different times by the first emission control signal e1n and so that the eighth transistor M8b2 and the second switching device Mbb2 are turned on or off at different times by the second emission control signal e2n.

The first electrode of the capacitor Cstb2 is connected to the pixel power source line of the pixel power source Vdd, and the second electrode of the capacitor Cstb2 is connected to the third node C5 so that the capacitor Cstb2 is initialized by the initializing signal transmitted to the third node C5 through the fourth transistor M4b2 and so that the voltage corresponding to the data signal is stored in the capacitor Cstb2 and is transmitted to the third node C5. Therefore, the gate voltage of the first transistor M1b2 is maintained for a predetermined time by the capacitor Cstb2.

Figure 11:
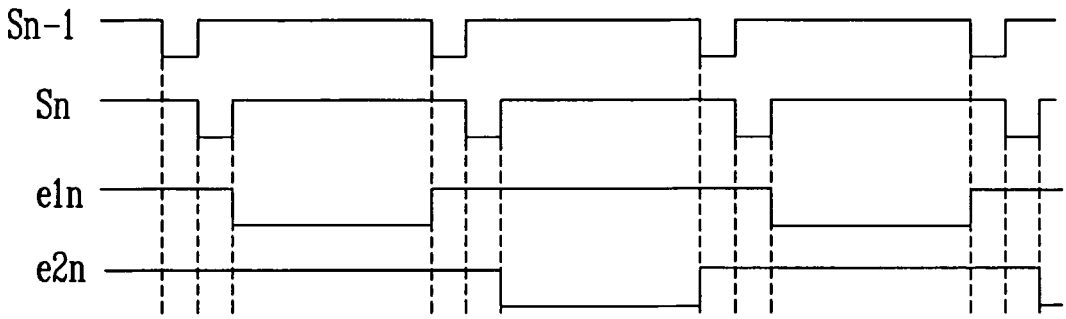
FIG. 11 illustrates a first embodiment of waveforms for operating the pixel of FIG. 9 and the pixel of FIG. 10.

FIG. 11 illustrates a first embodiment of waveforms for operating the pixel of FIG. 9 and the pixel of FIG. 10. Referring to FIG. 11, a pixel (e.g., a pixel 110b) is operated by the first and second scan signals sn and sn-1 and the first and second emission control signals e1n and e2n.

For exemplary purposes, an operation of the pixel of FIG. 10 will be described in more detail with the waveforms of FIG. 11. In operation, the fourth transistor M4b2 is first turned on by the second scan signal sn-1, and the initializing signal is transmitted to the capacitor Cstb2 through the fourth transistor M4b2 so that the capacitor Cstb2 is initialized.

Then, the second and third transistors M2b2 and M3b2 are turned on by the first scan signal sn so that the potential of the second node B5 is made equal to the potential of the third node C5. Therefore, the first transistor M1*b*2 is connected like a diode so that an electric current can flow through the first transistor M1*b*2. In addition, the data signal is transmitted to the second node B5 through the second transistor M2*b*2. Therefore, the data signal is applied to the second electrode of the capacitor Cstb2 through the second transistor M2*b*2, the first transistor M1*b*2, and the third transistor M3*b* so that the voltage corresponding to difference between the data signal and the threshold voltage is applied to the second electrode of the capacitor Cstb2.

After the first scan signal sn is transited to the high level, when the first emission control signal e1*n* is transited to the low level and is maintained in the low level for a predetermined time, the fifth and seventh transistors M5*b*2 and M7*b*2 are turned on by the first emission control signal e1*n* so that the voltage corresponding to the EQUATION 1 is applied between the gate and source of the first transistor M1*b*2.

Therefore, the current corresponding to the EQUATION 2 flows to the first node A5 regardless of the threshold voltage of the first transistor M1*b*2.

At this time, since the second emission control signal e2*n* is in the high level and the first emission control signal e1*n* is in the low level state, the first switching device Mab2 is maintained to be turned off by the first emission control signal e1*n* so that the first switching device Mab2 is turned off. Therefore, the current that flows to the first OLED OLED1*b*2 is not affected by the second emission control signal e2*n*.

On the other hand, the second switching device Mbb2 is turned on by the second emission control signal e2*n*. At this time, since the signal e1*n* transmitted through the first emission control line E1*n* connected to the source of the second switching device Mbb2 is in the low level, the low signal is transmitted to the anode electrode of the second OLED OLED2*b*2 so that the second OLED OLED2*b*2 is reverse biased.

Then, the voltage value corresponding to difference between the pixel power source and the data signal is stored in the capacitor Cstb2 in accordance the first and second scan signals sn and sn-1, the voltage corresponding to the EQUATION 1 is applied between the source and gate of the first transistor M1*b*2, the sixth and eighth transistors M6*b*2 and M8*b*2 are turned on by the second emission control signal e2*n*, and the current corresponding to the EQUATION 2 flows to the second OLED OLED2*b*2.

At this time, since the first emission control signal e1*n* is in the high level and the second emission control signal e2*n* is in the low level, the seventh transistor M7*b*2 is turned off and the eighth transistor M8*b*2 is turned on so that the current flows to the second OLED OLED2*b*2 through the eighth transistor M8*b*2. The first switching device Mab2 is maintained to be turned on by the first emission control signal e1*n* so that the second emission control signal e2*n* connected to the source of the first switching device Mab2 is transmitted to the first OLED OLED1*b*2. Therefore, the first OLED OLED1*b*2 is reverse biased. On the other hand, the second switching device Mbb2 is turned off so that the current that flows to the second OLED OLED2*b*2 is not affected by the first emission control signal e1*n*.

Figure 12:
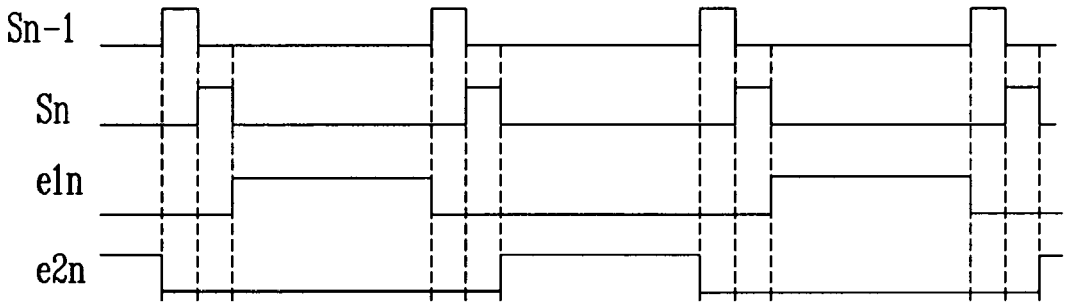
FIG. 12 illustrates a second embodiment of waveforms for operating the pixel of FIG. 9 and the pixel of FIG. 10.

Here, in the pixels of FIGS. 9 and 10, the first to eighth transistors M1*b* to M8*b* (e.g., M1*b*1 to M8*b*1 or M1*b*2 to M8*b*2) are formed of the PMOS transistors, and the first and second switching devices Mab and Mbb (e.g., Mab1 and Mbb1 or Mab2 and Mab2) are formed of the NMOS transistors. However, when the first to eighth transistors M1*b* to M8*b* are formed of the NMOS transistors and the first and second switching devices Ma and Mb are formed of the PMOS transistors, the pixel(s) operates in accordance with the waveforms illustrated in FIG. 12.

As described above, according to a pixel circuit and a light emitting display of the present invention, a reverse bias (or a reverse bias voltage) can be easily applied in the periods when OLEDs do not emit light and thus can improve the characteristics of the OLEDs. Also, since a plurality of OLEDs are connected to one pixel circuit, it is possible to reduce the number of pixel circuits of a light emitting display and thus to improve the aperture ratio of the light emitting display.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A pixel comprising:

first and second organic light emitting diodes (OLEDs);

a driving circuit commonly connected to the first and second OLEDs to drive the first and second OLEDs;

a switching circuit connected between the first and second OLEDs and the driving circuit to sequentially control the driving of the first and second OLEDs using first and second emission control signals; and a reverse bias circuit for selectively applying a reverse bias voltage comprising at least one of the first and second emission control signals to the first and second OLEDs, wherein the driving circuit comprises:

a first transistor for receiving a first power of a first power source to selectively supply a driving current corresponding to a first voltage applied to a gate at the first transistor to the first and second OLEDs;

a second transistor for selectively applying a data signal to a first electrode of the first transistor in accordance with a first scan signal;

a third transistor for selectively connecting the first transistor to serve as a diode in accordance with the first scan signal so that an electric current can flow through the first transistor;

a capacitor for storing the voltage applied to the gate of the first transistor while the data signal is applied to the first electrode of the first transistor and for maintaining the stored voltage at the gate of the first transistor for a period when at least one of the first and second OLEDs emits light;

a fourth transistor for selectively applying an initializing voltage to the capacitor in accordance with a second scan signal;

a fifth transistor for selectively applying the first power of the first power source to the first transistor in accordance with the first emission control signal; and a sixth transistor for selectively applying the first power of the first power source to the first transistor in accordance with the second emission control signal.

2. The pixel as claimed in claim 1, wherein the reverse bias applying circuit comprises:

a first switching device for selectively applying the second emission control signal to the first OLED in accordance with the first emission control signal; and a second switching device for selectively applying the first emission control signal to the second OLED in accordance with the second emission control signal.

3. The pixel as claimed in claim 1, wherein the second scan signal is transmitted to a first scan line preceding a second scan line for transmitting the first scan signal.

4. The pixel as claimed in claim 1, wherein the initializing voltage comprises the second scan signal.

5. The pixel as claimed in claim 1, wherein the initializing voltage comprises a voltage applied to at least one of the first and second OLEDs when the first and second OLEDs are turned off.

6. A pixel comprising:

first and second organic light emitting diodes (OLEDs);

a driving circuit commonly connected to the first and second OLEDs to drive the first and second OLEDs;

a switching circuit connected between the first and second OLEDs and the driving circuit to sequentially control the driving of the first and second OLEDs using first and second emission control signals; and a reverse bias circuit connected to a reverse bias line for transmitting a reverse bias voltage to selectively apply the reverse bias voltage to the first and second OLEDs in accordance with the first and second emission control signals so that the reverse bias voltage is applied to the first and second OLEDs, wherein the driving circuit comprises:

a first transistor for receiving a first power of a first power source to selectively supply a driving current corresponding to a first voltage applied to a gate of the first transistor to the first and second OLEDs;

a second transistor for selectively applying a data signal to a first electrode of the first transistor in accordance with a first scan signal;

a third transistor for selectively connecting the first transistor to serve as a diode in accordance with the first scan signal so that an electric current can flow through the first transistor;

a capacitor for storing the voltage applied to the gate of the first transistor while the data signal is applied to the first electrode of the first transistor and for maintaining the stored voltage at the gate of the first transistor for a period when at least one of the first and second OLEDs emits light;

a fourth transistor for selectively applying an initializing voltage to the capacitor in accordance with a second scan signal;

a fifth transistor for selectively applying the first power of the first power source to the first transistor in accordance with the first emission control signal; and a sixth transistor for selectively applying the first power of the first power source to the first transistor in accordance with the second emission control signal.

7. The pixel as claimed in claim 6, wherein the reverse bias applying circuit comprises:

a first switching device for selectively applying the reverse bias voltage to the first OLED in accordance with the first emission control signal; and a second switching device for selectively applying the reverse bias voltage to the second OLED in accordance with the second emission control signal.

8. The pixel as claimed in claim 6, wherein the second scan signal is transmitted to a first scan line preceding a second scan line for transmitting the first scan signal.

9. The pixel as claimed in claim 6, wherein the initializing voltage comprises the second scan signal.

10. The pixel as claimed in claim 6, wherein the initializing voltage comprises a voltage applied to at least one of the first and second OLEDs when the first and second OLEDs are turned off.

11. A pixel comprising:

first and second organic light emitting diodes (OLEDs);

a driving circuit commonly connected to the first and second OLEDs to drive the first and second OLEDs;

a switching circuit connected between the first and second OLEDs and the driving circuit to sequentially control the driving of the first and second OLEDs using first and second emission control signals; and a reverse bias circuit connected to a reverse bias line for transmitting a reverse bias voltage and a reverse bias control line for transmitting a reverse voltage control signal to selectively apply the reverse bias voltage to the first and second OLEDs in accordance with the reverse voltage control signal so that the reverse bias voltage is applied to the first and second OLEDs, wherein the driving circuit comprises:

a first transistor for receiving a first power of a first power source to selectively supply a driving current corresponding to a first voltage applied to a gate of the first transistor to the first and second OLEDs;

a second transistor for selectively applying a data signal to a first electrode of the first transistor in accordance with a first scan signal;

a third transistor for selectively connecting the first transistor to serve as a diode in accordance with the first scan signal so that an electric current can flow through the first transistor;

a capacitor for storing the voltage applied to the gate of the first transistor while the data signal is applied to the first electrode of the first transistor and for maintaining the stored voltage at the gate of the first transistor for a period when at least one of the first and second OLEDs emits light;

a fourth transistor for selectively applying an initializing voltage to the capacitor in accordance with a second scan signal;

a fifth transistor for selectively applying the first power of the first power source to the first transistor in accordance with the first emission control signal; and a sixth transistor for selectively applying the first power of the first power source to the first transistor in accordance with the second emission control signal.

12. The pixel as claimed in claim 11, wherein the reverse bias applying circuit comprises:

a first switching device for selectively applying the reverse bias voltage to the first OLED in accordance with the reverse voltage control signal; and a second switching device for selectively applying the reverse bias voltage to the second OLED in accordance with the reverse voltage control signal.

13. The pixel as claimed in claim 11, wherein the reverse voltage control signal is at a switch turned-on level when at least one of the first and second scan signals is at a transistor turned-on level.

14. The pixel as claimed in claim 11, wherein the second scan signal is transmitted to a first scan line preceding a second scan line for transmitting the first scan signal.

15. The pixel as claimed in claim 11, wherein the initializing voltage comprises the second scan signal.

16. The pixel as claimed in claim 11, wherein the initializing voltage comprises a voltage applied to at least one of the first and second OLEDs when the first and second OLEDs are turned off.

17. A light emitting display comprising:

an image display unit including a plurality of pixels to display an image;

a scan driver for transmitting first and second scan signals and first and second emission control signals to the image display unit; and a data driver for transmitting a data signal to the image display unit, wherein at least one of the pixels comprises:

first and second organic light emitting diodes (OLEDs);

a driving circuit commonly connected to the first and second OLEDs to drive the first and second OLEDs;

a switching circuit connected between the first and second OLEDs and the driving circuit to sequentially control the driving of the first and second OLEDs using the first and second emission control signals; and a reverse bias circuit for selectively applying a reverse bias voltage comprising at least one of the first and second emission control signals to the first and second OLEDs, wherein the driving circuit comprises:

a first transistor for receiving a first power of a first power source to selectively supply a driving current corresponding to a first voltage applied to a gate of the first transistor to the first and second OLEDs;

a second transistor for selectively applying a data signal to a first electrode of the first transistor in accordance with the first scan signal;

a third transistor for selectively connecting the first transistor to serve as a diode in accordance with the first scan signal so that an electric current can flow through the first transistor;

a capacitor for storing the voltage applied to the gate of the first transistor while the data signal is applied to the first electrode of the first transistor and for maintaining the stored voltage at the gate of the first transistor for a period when at least one of the first and second OLEDs emits light;

a fourth transistor for selectively applying an initializing voltage to the capacitor in accordance with the second scan signal;

a fifth transistor for selectively applying the first power of the first power source to the first transistor in accordance with the first emission control signal; and a sixth transistor for selectively applying the first power of the first power source to the first transistor in accordance with the second emission control signal.

18. A light emitting display comprising:

an image display unit including a plurality of pixels to display an image;

a scan driver for transmitting first and second scan signals and first and second emission control signals to the image display unit; and a data driver for transmitting a data signal to the image display unit, wherein at least one of the pixels comprises:

first and second organic light emitting diodes (OLEDs);

a driving circuit commonly connected to the first and second OLEDs to drive the first and second OLEDs;

a switching circuit connected between the first and second OLEDs and the driving circuit to sequentially control the driving of the first and second OLEDs using the first and second emission control signals; and a reverse bias circuit connected to a reverse bias line for transmitting a reverse bias voltage to selectively apply the reverse bias voltage to the first and second OLEDs in accordance with the first and second emission control signals so that the reverse bias voltage is applied to the first and second OLEDS, wherein the driving circuit comprises:

a first transistor for receiving a first power of a first power source to selectively supply a driving current corresponding to a first voltage applied to a gate of the first transistor to the first and second OLEDs;

a second transistor for selectively applying a data signal to a first electrode of the first transistor in accordance with the first scan signal;

a third transistor for selectively connecting the first transistor to serve as a diode in accordance with the first scan signal so that an electric current can flow through the first transistor;

a capacitor for storing the voltage applied to the gate of the first transistor while the data signal is applied to the first electrode of the first transistor and for maintaining the stored voltage at the gate of the first transistor for a period when at least one of the first and second OLEDs emits light;

a fourth transistor for selectively applying an initializing voltage to the capacitor in accordance with the second scan signal;

a fifth transistor for selectively applying the first power of the first power source to the first transistor in accordance with the first emission control signal; and a sixth transistor for selectively applying the first power of the first power source to the first transistor in accordance with the second emission control signal

19. A light emitting display comprising:

an image display unit including a plurality of pixels to display an image;

a scan driver for transmitting first and second scan signals and first and second emission control signals to the image display unit; and a data driver for transmitting a data signal to the image display unit, wherein at least one of the pixels comprises:

first and second organic light emitting diodes (OLEDs);

a driving circuit commonly connected to the first and second OLEDs to drive the first and second OLEDs;

a switching circuit connected between the first and second OLEDs and the driving circuit to sequentially control the driving of the first and second OLEDs using the first and second emission control signals; and a reverse bias circuit connected to a reverse bias line for transmitting a reverse bias voltage and a reverse bias control line for transmitting a reverse bias voltage control signal to selectively apply the reverse bias voltage to the first and second OLEDs in accordance with the reverse bias voltage control signal so that the reverse bias voltage is applied to the first and second OLEDs, wherein the driving circuit comprises:

a first transistor for receiving a first power of a first power source to selectively supply a driving current corresponding to a first voltage applied to a gate of the first transistor to the first and second OLEDs;

a second transistor for selectively applying the data signal to a first electrode of the first transistor in accordance with the first scan signal;

a third transistor for selectively connecting the first transistor to serve as a diode in accordance with the first scan signal so that an electric current can flow through the first transistor;

a capacitor for storing the voltage applied to the gate of the first transistor while the data signal is applied to the first electrode of the first transistor and for maintaining the stored voltage at the gate of the first transistor for a period when at least one of the first and second OLEDs emits light;

a fourth transistor for selectively applying an initializing voltage to the capacitor in accordance with the second scan signal;

a fifth transistor for selectively applying the first power of the first power source to the first transistor in accordance with the first emission control signal; and a sixth transistor for selectively applying the first power of the first power source to the first transistor in accordance with the second emission control signal.

20. A pixel for a light emitting display comprising:

first and second organic light emitting diodes (OLEDs);

a driving circuit commonly connected to the first and second OLEDs to drive the first and second OLEDs;

a switching circuit connected between the first and second OLEDs and the driving circuit to sequentially control the driving of the first and second OLEDs using first and second emission control signals; and a reverse bias circuit for selectively applying a reverse bias voltage to the first and second OLEDs wherein the driving circuit comprises:

a first transistor for receiving a first power of a first power source to selectively supply a driving current corresponding to a first voltage applied to a gate of the first transistor to the first and second OLEDs;

a second transistor for selectively applying a data signal to a first electrode of the first transistor in accordance with a first scan signal;

a third transistor for selectively connecting the first transistor to serve as a diode in accordance with the first scan signal so that an electric current can flow through the first transistor;

a capacitor for storing the voltage applied to the gate of the first transistor while the data signal is applied to the first electrode of the first transistor and for maintaining the stored voltage at the gate of the first transistor for a period when at least one of the first and second OLEDs emits light;

a fourth transistor for selectively applying an initializing voltage to the capacitor in accordance with a second scan signal;

a fifth transistor for selectively applying the first power of the first power source to the first transistor in accordance with the first emission control signal; and a sixth transistor for selectively applying the first power of the first power source to the first transistor in accordance with the second emission control signal.

21. The pixel as claimed in claim 20, wherein the reverse bias voltage comprises at least one of the first and second emission control signals.

22. The pixel as claimed in claim 21, wherein the reverse bias circuit selectively applies the reverse bias voltage to the first and second OLEDs in accordance with one of the first and second emission control signals when another one of the first and second emission control signals is used as the reverse bias voltage.

23. The pixel as claimed in claim 20, wherein the reverse bias circuit is connected to a reverse bias line for transmitting the reverse bias voltage and selectively applies the reverse bias voltage to the first and second OLEDs in accordance with the first and second emission control signals.

24. The pixel as claimed in claim 20, wherein the reverse bias circuit is connected to a reverse bias line for transmitting a reverse bias voltage and a reverse bias control line for transmitting a reverse bias voltage control signal, and wherein the reverse bias circuit selectively applies the reverse bias voltage to the first and second OLEDs in accordance with the reverse bias voltage control signal.

* * * * *